US009880506B2

(12) United States Patent
Watanabe

(10) Patent No.: US 9,880,506 B2
(45) Date of Patent: Jan. 30, 2018

(54) PRINT CONTROL APPARATUS, METHOD FOR CONTROLLING PRINT CONTROL APPARATUS, AND STORAGE MEDIUM

(71) Applicant: CANON KABUSHIKI KAISHA, Tokyo (JP)

(72) Inventor: Tomoaki Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/227,537

(22) Filed: Aug. 3, 2016

(65) Prior Publication Data

US 2017/0038723 A1 Feb. 9, 2017

(30) Foreign Application Priority Data

Aug. 6, 2015 (JP) ..... 2015-155654
May 27, 2016 (JP) ..... 2016-106210

(51) Int. Cl.
*G03G 15/00* (2006.01)

(52) U.S. Cl.
CPC ..... *G03G 15/6541* (2013.01)

(58) Field of Classification Search
CPC ..... G03G 15/6541
USPC ..... 399/408
See application file for complete search history.

(56) References Cited

U.S. PATENT DOCUMENTS 7,957,024 B2 * 6/2011 Tokashiki ..... B42C 19/02 358/1.13
8,879,111 B2 * 11/2014 Yamasaki ..... G06F 3/1204 358/1.15
9,317,234 B2 * 4/2016 Watanabe ..... G06F 3/1256
2004/0218217 A1 * 11/2004 Dechamps ..... G06F 17/27 358/1.18
2011/0135366 A1 * 6/2011 Asai ..... B42C 19/02 399/408
2013/0045851 A1 * 2/2013 Hori ..... G03G 15/5095 493/405
2015/0086298 A1 * 3/2015 Kubota ..... G03G 15/6544 412/16

FOREIGN PATENT DOCUMENTS

JP 2011-70449 A 4/2011

* cited by examiner

*Primary Examiner* — Anthony Nguyen
(74) *Attorney, Agent, or Firm* — Canon USA, Inc. I.P. Division

(57) ABSTRACT

A print control apparatus receives a request for printing that contains a binding direction at the time of case binding using a signature, and determines whether the binding direction contained in the received request is a predetermined binding direction. The print control apparatus performs imposition processing so as to achieve a predetermined folding direction of the signature and issues an instruction to carry out the printing if the received binding direction is determined to be the predetermined binding direction, and performs the imposition processing in such a manner that a folding direction of the signature matches the predetermined folding direction of the signature and also issues an instruction to carry out the printing so as to reverse an order of discharging paper if the received binding direction is determined not to be the predetermined binding direction.

11 Claims, 18 Drawing Sheets

FIG.5

| 501 | 502 | 503 | 504 | 505 | 506 | 507 | 508 | 509 | 510 |
|---|---|---|---|---|---|---|---|---|---|
| ORDER ACCEPTANCE NO. | MERCHANDISE NAME | BINDING DIRECTION | PRODUCT NAME | QUANTITY | PAPER GRAMMAGES | PAPER COLORS | PAPER TYPES | PAGE NUMBER | DATA |
| 00000782 | PERFECT-BINDING BOOK | RIGHT | MANAGEMENT TECHNIQUE | 2 | 79, 190 | WHITE, WHITE | Plain, Coated | 90 | //Data/782/body.pdf, //Data/782/cover.pdf |
| 00000594 | BURST-PERFECT-BINDING BOOK | LEFT | PRODUCT MANUAL | 1 | 79, 190 | WHITE, WHITE | Plain, Coated | 180 | //Data/594/body.pdf, //Data/594/cover.pdf |

FIG.11

1101 1102 1103 1104

```
<Folding catalog="F16-7" grid="4 2" binding="right" direction="head">
<Imposition page="1" position="3 1 0"/>
<Imposition page="2" position="2 1 1"/>
<Imposition page="3" position="3 1 1"/>
...
<Imposition page="16" position="4 1 0"/>
</Folding>
```

1105 1106

FOR RIGHT-BINDING BOOKBINDING

BOTTOM-FOLDING IMPOSITION

FIG.15A

FRONT SIDE 1501 BACK SIDE 1502

FIRST FOLDING

| | | | |
|---|---|---|---|
| 4 | 1 | 2 | 3 |
| 5 | 8 | 7 | 6 |

1513

SECOND FOLDING

| | | | |
|---|---|---|---|
| 12 | 9 | 10 | 11 |
| 13 | 16 | 15 | 14 |

1515

FIG.15B

TOP-FOLDING IMPOSITION

FRONT SIDE 1503 BACK SIDE 1504

| | | | |
|---|---|---|---|
| 5 | 8 | 7 | 6 |
| 4 | 1 | 2 | 3 |

1514

| | | | |
|---|---|---|---|
| 13 | 16 | 15 | 14 |
| 12 | 9 | 10 | 11 |

1516

FIG.15C

FRONT SIDE 1505 BACK SIDE 1506

FIRST FOLDING

| | | | |
|---|---|---|---|
| 5 | 12 | 9 | 8 |
| 4 | 13 | 16 | 1 |

| | | | |
|---|---|---|---|
| 7 | 10 | 11 | 6 |
| 2 | 15 | 14 | 3 |

SECOND FOLDING

| | | | |
|---|---|---|---|
| 21 | 28 | 25 | 24 |
| 20 | 29 | 32 | 17 |

| | | | |
|---|---|---|---|
| 23 | 26 | 27 | 22 |
| 18 | 31 | 30 | 19 |

FIG.15D

FRONT SIDE 1507 BACK SIDE 1508

| | | | |
|---|---|---|---|
| 12 | 5 | 8 | 6 |
| 13 | 4 | 1 | 16 |

| | | | |
|---|---|---|---|
| 10 | 7 | 9 | 11 |
| 15 | 2 | 3 | 14 |

| | | | |
|---|---|---|---|
| 28 | 21 | 24 | 25 |
| 29 | 20 | 17 | 32 |

| | | | |
|---|---|---|---|
| 26 | 23 | 22 | 27 |
| 31 | 18 | 19 | 30 |

FIG.15E

FRONT SIDE 1509 BACK SIDE 1510

FIRST FOLDING

| | | | |
|---|---|---|---|
| 28 | 21 | 24 | 25 |
| 5 | 12 | 9 | 8 |
| 4 | 13 | 16 | 1 |
| 29 | 20 | 17 | 32 |

| | | | |
|---|---|---|---|
| 26 | 23 | 22 | 27 |
| 7 | 10 | 11 | 6 |
| 2 | 15 | 14 | 3 |
| 31 | 18 | 19 | 30 |

SECOND FOLDING

| | | | |
|---|---|---|---|
| 60 | 53 | 56 | 57 |
| 37 | 44 | 41 | 40 |
| 36 | 45 | 48 | 33 |
| 61 | 52 | 49 | 64 |

| | | | |
|---|---|---|---|
| 58 | 55 | 54 | 59 |
| 39 | 42 | 43 | 38 |
| 34 | 47 | 46 | 35 |
| 63 | 50 | 51 | 62 |

FIG.15F

FRONT SIDE 1511 BACK SIDE 1512

| | | | |
|---|---|---|---|
| 5 | 12 | 9 | 8 |
| 28 | 21 | 24 | 25 |
| 29 | 20 | 17 | 32 |
| 4 | 13 | 16 | 1 |

| | | | |
|---|---|---|---|
| 7 | 10 | 11 | 6 |
| 26 | 23 | 22 | 27 |
| 31 | 18 | 19 | 30 |
| 2 | 15 | 14 | 3 |

| | | | |
|---|---|---|---|
| 37 | 60 | 61 | 36 |
| 44 | 53 | 52 | 45 |
| 41 | 56 | 49 | 48 |
| 40 | 57 | 64 | 33 |

| | | | |
|---|---|---|---|
| 39 | 58 | 63 | 34 |
| 42 | 55 | 50 | 47 |
| 43 | 54 | 51 | 46 |
| 38 | 59 | 62 | 35 |

FOR LEFT-BINDING BOOKBINDING

TOP-FOLDING IMPOSITION

BOTTOM-FOLDING IMPOSITION

PRINT CONTROL APPARATUS, METHOD FOR CONTROLLING PRINT CONTROL APPARATUS, AND STORAGE MEDIUM

BACKGROUND OF THE INVENTION

Field of the Invention

The present invention relates to a print control apparatus that controls printing for bookbinding using a signature, a method for controlling the print control apparatus, and a storage medium.

Description of the Related Art

On-demand printing is prevalent at production sites according to the improvement of the printing technique due to the digitalization of image forming apparatuses and methods for accepting an order. In recent years, the digital printing of on-demand printing has also been pursuing manufacturing efficiency and a reduction in waste paper by imposing a plurality of pages on a single piece of paper (hereinafter referred to as multi-imposition). When the multi-imposition is used during a manufacturing process, the paper with the pages printed thereon is set on a folding apparatus and is folded into a signature, and the fold is cut lastly, which creates a product constituted by the pages.

Further, some kinds of the recent on-demand printing handle case binding as a product, and the case binding is characterized in that a creation method thereof is different depending on a binding direction.

Generally, bottom folding is often used for a signature intended for bookbinding of right binding, as a common practice. By making an arrangement so as to create a signature of left binding by top folding and create the signature of the right binding by the bottom folding, the signature can be created with a setting of the folding apparatus remaining the same regardless of the left binding or the right binding.

In recent years, there has been prepress apparatuses using a template included in functions of prepress software as a technique regarding the imposition. The prepress software stores a pagination template in which the binding direction and the folding direction of a book are associated with each other in advance, thereby allowing a user to carry out the imposition without making a mistake (refer to Japanese Patent Application Laid-Open No. 2011-70449).

However, the above-described conventional technique facilitates the imposition of the signature but leaves the necessity of setting a front cover in a matching orientation when setting the signature on the bookbinding apparatus. For example, when the signature of a book body is set on the bookbinding apparatus, the folding direction, a corner of which is supposed to be tough, should be placed into abutment with a holder at the bookbinding apparatus.

Therefore, if the fold of the signature intended for the left-binding bookbinding that is created as the top folding is set in a rightward orientation when facing the bookbinding apparatus, a top of the front cover should be set in the rightward orientation (refer to FIG. 7, which will be described below).

On the other hand, when the fold of the signature intended for the right-binding bookbinding that is created as the bottom folding is set in the rightward orientation when facing the bookbinding apparatus in a similar manner, the top of the front cover should be set in the leftward orientation (refer to FIG. 8A, which will be described below).

Therefore, in such a case that there are both the left-binding bookbinding and the right-binding bookbinding in a mixed manner, the top of the printed front cover should be set in the rightward orientation or the leftward orientation according to the binding direction of the book, which leads to an extremely complicated process. For example, in such a case that the left-binding bookbinding and the right-binding bookbinding are carried out alternately, the top of the printed front cover should be set alternately set in the rightward orientation and in the leftward orientation.

In this manner, an operator should engage in a task of determining the binding direction and switching the orientation of the front cover with respect to the front cover placed on a paper discharge portion of a printer based on a picture thereon and/or management information indicating the orientation regarding the binding direction, and this task involves a problem such as being inefficient for the operator and also having a possibility of becoming a factor to cause a mistake.

SUMMARY OF THE INVENTION

The present invention is directed to providing a mechanism capable of realizing print control that can reduce a load on the operator at the time of the case binding of the signature, thereby improving work efficiency and preventing or reducing occurrence of a mistake.

According to an aspect of the present invention, a print control apparatus controls printing for bookbinding using a signature, and includes a reception unit configured to receive a request for the printing that contains a binding direction at the time of the bookbinding, a determination unit configured to determine whether the binding direction contained in the request received by the reception unit is a binding direction serving as a reference, and a control unit configured to perform imposition processing predetermined in correspondence with the received binding direction and issue an instruction to carry out the printing if the received binding direction is determined to be the binding direction serving as the reference, and change imposition processing from imposition processing predetermined in correspondence with the binding direction to imposition processing that achieves a same folding direction as the binding direction serving as the reference and also issue an instruction to carry out the printing so as to reverse an order of discharging paper if the received binding direction is determined not to be the binding direction serving as the reference.

Further features of the present invention will become apparent from the following description of exemplary embodiments with reference to the attached drawings.

BRIEF DESCRIPTION OF THE DRAWINGS

FIG. 5 illustrates an example of request information received by a request information reception unit.

FIG. 11 illustrates an example of an imposition template to be used in the folding imposition.

FIGS. 15A, 15B, 15C, 15D, 15E, and 15F illustrate a change in an imposition method in conformity with the right binding serving as the reference.

DESCRIPTION OF THE EMBODIMENTS

In the following description, an exemplary embodiment for embodying the present invention will be described with reference to the drawings.

In the present exemplary embodiment, an example of a Print On Demand (POD) printing system, which receives a request for a print product from outside a pressroom and manufactures a book based on this information, will be described in detail.

In the POD printing system (hereinafter referred to as the printing system) according to the present exemplary embodiment, request information is received from a client, and a user selects order acceptance on an application screen and then presses a manufacturing start button, thereby issuing an instruction to start manufacturing. After the instruction to start the manufacturing is issued from the user, a print control apparatus according to the present exemplary embodiment performs processing for imposing pages for a signature, processing for changing positions of post-processing marks, and processing for changing a print instruction. Then, a corresponding manufacturing instruction is transmitted to each of a printer, a folding apparatus, and a bookbinding apparatus, and the user conveys this printout output from the printer to each of the post-processing apparatuses and performs the post-processing for the bookbinding. The client is assumed to provide an instruction specifying a binding direction of the product for each file. Now, details thereof will be described with reference to the drawings.

Figure 1A:
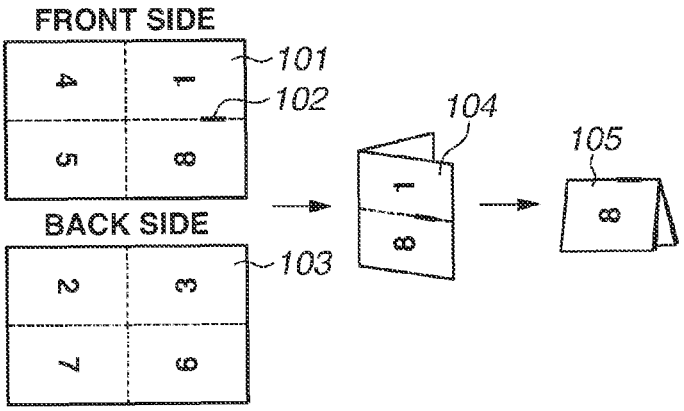
FIGS. 1A, 1B, and 1C each illustrate a signature handled by a print control apparatus according to an exemplary embodiment of the present invention.
Figure 1B:
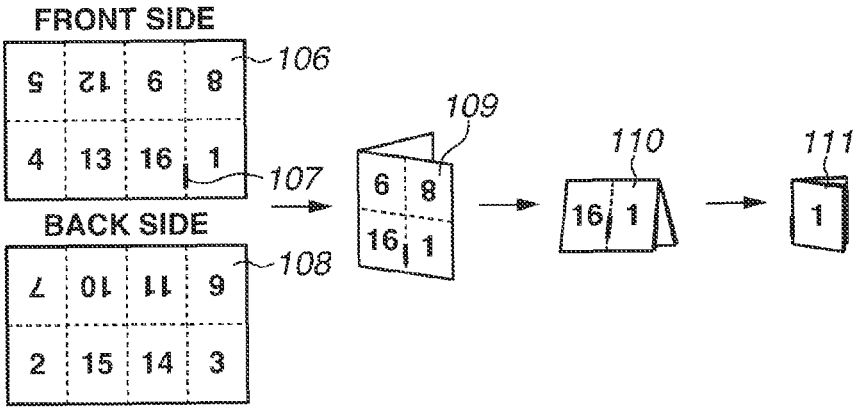
Figure 1C:
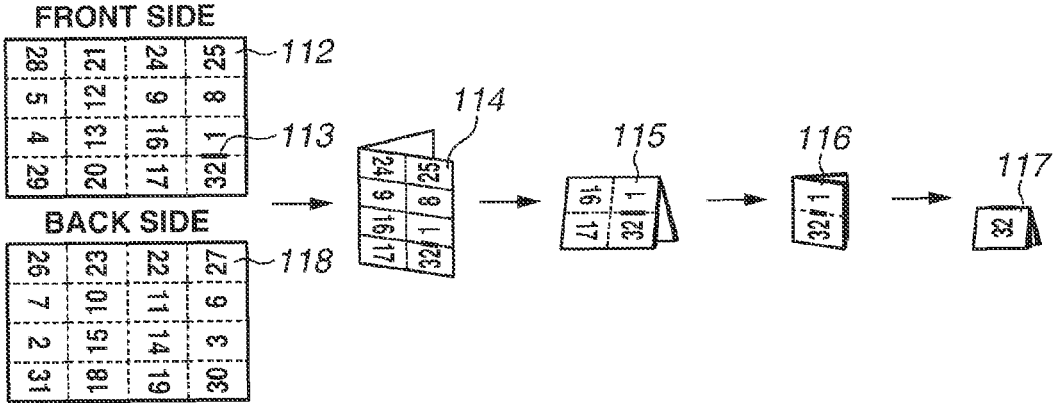

FIGS. 1A, 1B, and 1C each illustrate the signature handled by the print control apparatus according to the present exemplary embodiment.

As illustrated in FIGS. 1A, 1B, and 1C, the signature refers to, for example, a folded sheet formed by printing a total of 16 pages, 8 pages, or 32 pages on both sides of a single large piece of paper and then folding this paper.

FIG. 1A illustrates an example of 8-page folding, where 8 pages are laid out on one piece of paper.

FIG. 1B illustrates an example of 16-page folding, where 16 pages are laid out on one piece of paper.

FIG. 1C illustrates an example of 32-page folding, where 32 pages are laid out on one piece of paper.

Printing of the signature prints the pages laid out on a front side (101, 106, or 112) and a back side (103, 108, or 118) with use of imposition software so that the pages would be arranged in a correct page order after the paper is folded.

The folding apparatus creates the signature by folding the paper with the printed pages thereon in half vertically (104, 109, or 114), rotating the folded paper by 90 degrees, further folding the rotated paper in half (105, 110, or 115), and then repeating that like 111, 116, or 117. Further, generally, it is a common practice to also print information such as a collating mark 102, 107, or 113 so as to prevent a failure in alignment of signatures.

Figure 2:
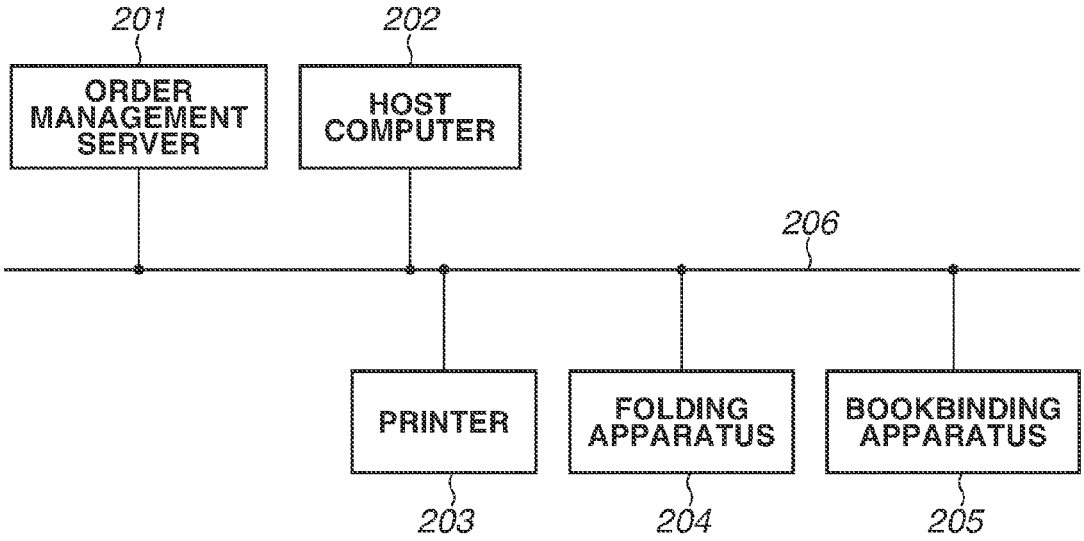
FIG. 2 illustrates a network configuration of a printing system to which the print control apparatus according to the present exemplary embodiment is applicable.

Next, diagrams illustrating a network configuration and a system internal configuration according to the present exemplary embodiment will be described. FIG. 2 illustrates an example of the network configuration of the printing system to which the print control apparatus indicating one exemplary embodiment of the present invention is applicable.

The printing system according to the present exemplary embodiment includes an order management server 201, a host computer 202, a printer 203, which is in charge of the printing, a folding apparatus 204, which creates the signature, and a bookbinding apparatus 205, which is in charge of the bookbinding. These apparatuses are communicably connected to one another via a network 206.

The order management server 201 manages the request for the print product from outside the pressroom, and a file and the request information to be used in the printing are downloaded from this order management server 201 in the printing system according to the present exemplary embodiment.

The host computer 202 functions as the print control apparatus according to the present exemplary embodiment. The host computer 202 performs processing illustrated in flowcharts that will be described below and issues the manufacturing instruction to each of the printer 203, the folding apparatus 204, and the bookbinding apparatus 205 based on the file and the request information downloaded from the order management server 201.

The printer 203 prints contents of a front cover and a book body to be used in the case binding based on the instruction from the host computer 202 or the like. The folding apparatus 204 creates the signature by folding the book body printed while being processed by the multi-imposition, as many times as the number of times of folding based on the manufacturing instruction, based on the instruction from the host computer 202 or the like. The bookbinding apparatus 205 creates a case-binding product by carrying out gluing and three-side trimming with use of the created signature and the front cover based on the instruction from the host computer 202 or the like. The manufacturing instructions for the signature and toward the bookbinding apparatus 205 are assumed to be issued from the host computer 202, but the printing system may be configured in such a manner that these instructions are not issued from the host computer 202 but a parameter regarding the manufacturing is input directly by the user from an operation panel or the like on each of the folding apparatus 204 and the bookbinding apparatus 205. In a case where the printing system is a small-scale system, the order management server 201 and the host computer 202 may be the same computer. Further, a plurality of printers, a plurality of folding apparatuses, and a plurality of bookbinding apparatuses may be connected according to a volume of production.

Figure 3:
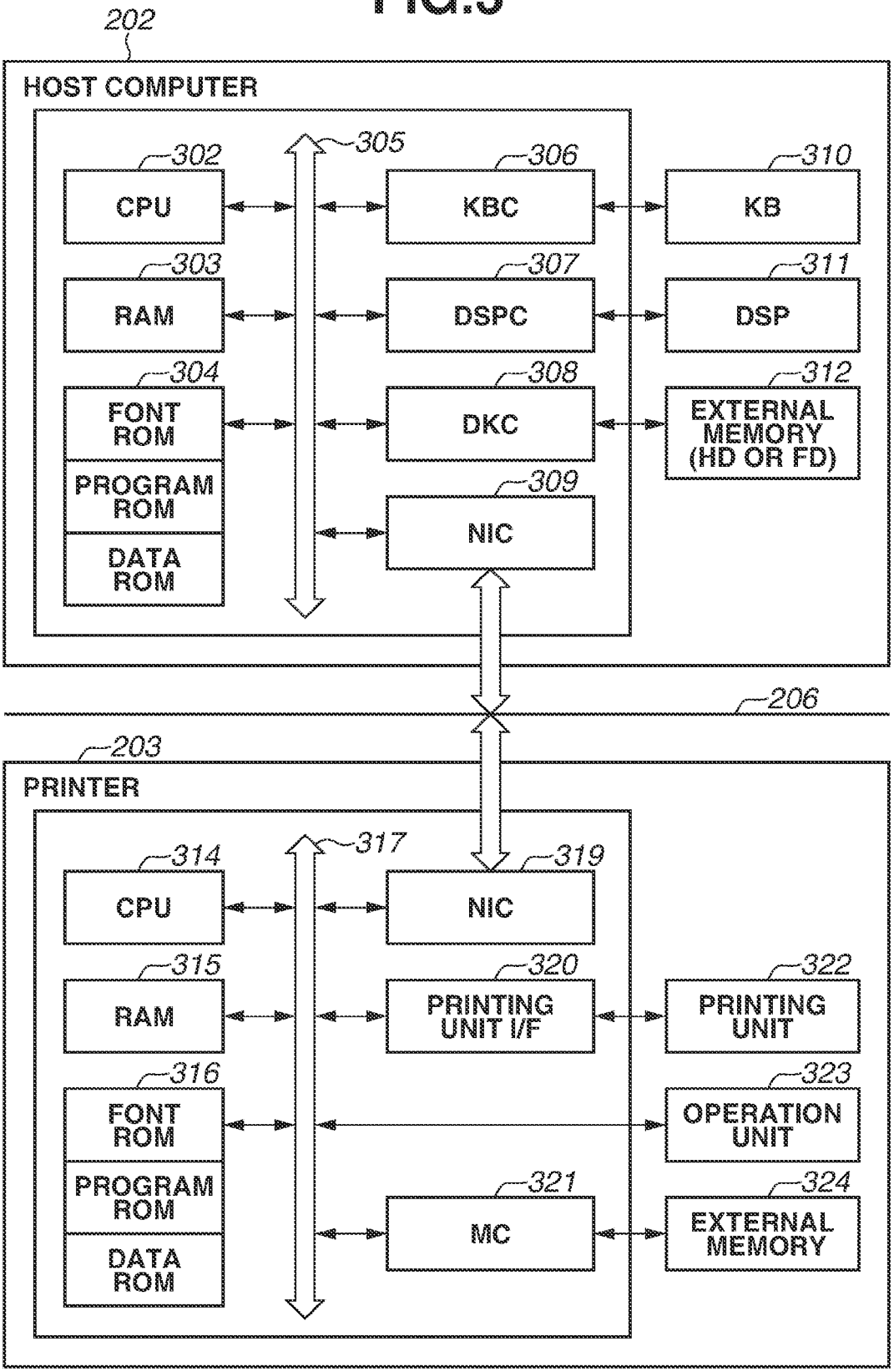
FIG. 3 illustrates a hardware configuration of a host computer and a printer.

FIG. 3 is a block diagram illustrating an example of a hardware configuration of the host computer 202 and the printer 203. The host computer 202 and the printer 203 may be any of a single apparatus, a system including a plurality of apparatuses, and a system in which a connection is established via a network such as a local area network (LAN) and a wide area network (WAN) and processing is performed, as long as functions of the present exemplary embodiment can be fulfilled.

In the host computer 202, a central processing unit (CPU) 302 comprehensively controls each unit connected to a system bus 305. The CPU 302 performs, for example, processing of a document in which a graphic, an image, a character, a table (including a spreadsheet and the like), and/or the like are mixed therein, and the processing illustrated in the flowcharts that will be described below, based on a program stored in a program read only memory (ROM) of a ROM 304 or an external memory 312.

The program ROM of the ROM 304 or the external memory 312 stores an operating system program (hereinafter referred to as an OS), which is a control program of the CPU 302, a printer driver, which will be described below, and the like. A font ROM of the ROM 304 or the external memory 312 stores font data to be used at the time of the above-described processing of the document, and the like. A data ROM of the ROM 304 or the external memory 312 stores various kinds of data to be used when the above-described processing of the document or the like is performed.

A random access memory (RAM) 303 functions as a main memory, a work area, and the like of the CPU 302.

A keyboard controller (KBC) 306 controls key inputs from a keyboard 310 and a pointing device (not-illustrated). A display controller (DSPC) 307 controls a display on a display (DSP) 311. A disk controller (DKC) 308 controls access to the external memory 312. The external memory 312 stores a boot program, various kinds of applications, the font data, a user file, an edited file, various kinds of programs including a program for generating a command for controlling the printer 203 (hereinafter referred to as the printer driver), and/or the like. The external memory 312 may be a hard disk (HD), a solid state drive (SSD), a flexible disk (FD), or another storage device.

A network interface card (NIC) 309 performs processing for controlling communication with an apparatus via the network 206. This processing allows the host computer 202 to bi-directionally communicate with the order management server 201, the printer 203, the folding apparatus 204, and the bookbinding apparatus 205.

In the printer 203, a CPU 314 comprehensively controls each unit connected to a system bus 317. The CPU 314 outputs an image signal as output information to a printing unit (a printer engine) 322 connected to the system bus 317 based on, for example, a control program stored in a program ROM of a ROM 316 or an external memory 324.

The program ROM of the ROM 316 stores the control program of the CPU 314, and the like. A font ROM stores font data to be used when the above-described output information is generated, and the like. A data ROM stores information to be used on the host computer 202, and the like, in a case where the printer 203 is a printing apparatus unequipped with the external memory 324, such as a hard disk.

A RAM 315 is a RAM that functions as a main memory, a work area, and the like of the CPU 314, and is configured to be able to expand a memory capacity by an optional RAM connected to an expansion port (not-illustrated). The RAM 315 is used as an area into which the output information is developed, an area storing environmental data, a nonvolatile random access memory (NVRAM), and the like.

The external memory 324 is a storage device such as an HD, an SSD, and an integrated circuit (IC) card. Access to the external memory 324 is controlled by a memory controller (MC) 321. The external memory 324 is optionally connected, and stores font data, an emulation program, form data, and/or the like. Further, the number of external memory(ies) 324 is not limited to one. The printer 203 may include a plurality of external memories 324, and be configured to allow connections of the plurality of external memories 324 storing optional cards and programs for interpreting printer control languages belonging to different language series in addition to a built-in font. Further, the printer 203 may include a NVRAM (not-illustrated), and be configured to store information indicating a setting of a printer mode input from an operation unit 323.

A printing unit interface (a printing unit I/F) 320 controls the printing unit 322. A switch, a light-emitting diode (LED) indicator, and the like for an operation on an operation panel are disposed on the operation unit 323.

A NIC 319 performs processing for controlling communication with an apparatus via the network 206. The CPU 314 is configured to be able to perform processing for communicating with the host computer 202 via the NIC 319, and can notify the host computer 202 of, for example, information in the printing apparatus.

Figure 4:
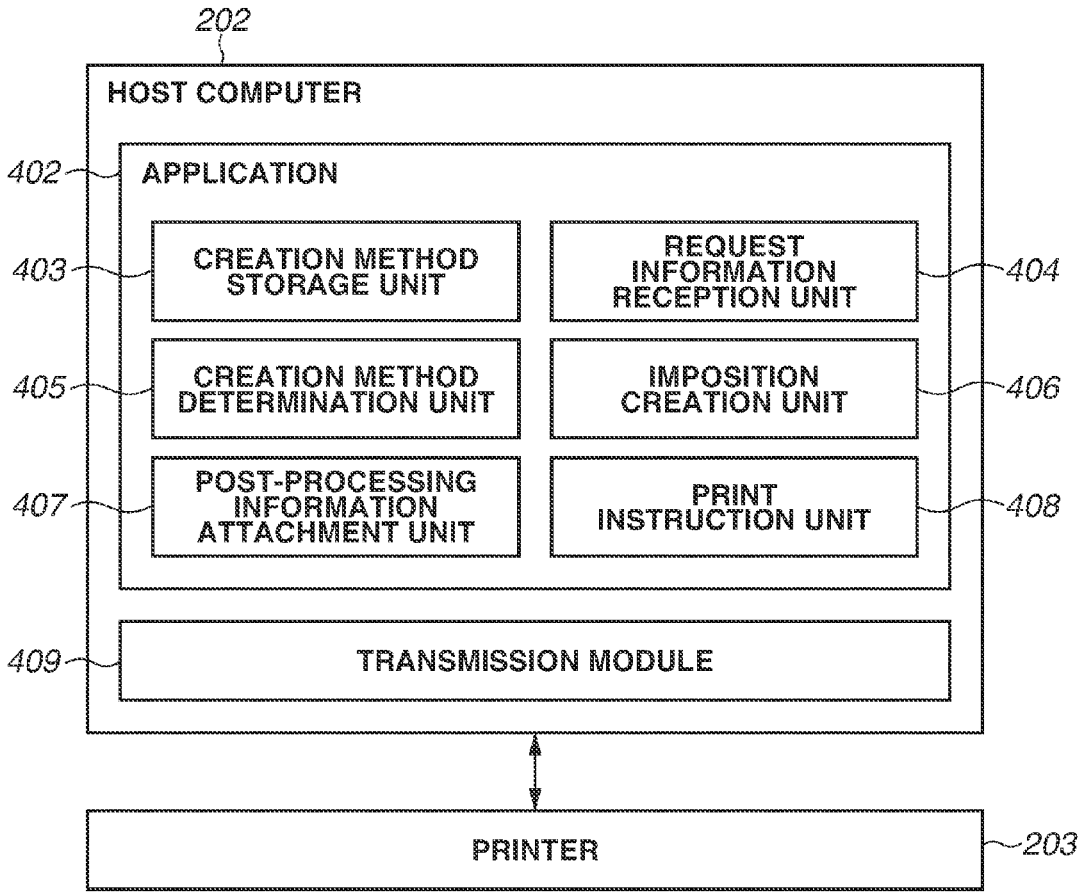
FIG. 4 illustrates a software configuration of the host computer.

FIG. 4 illustrates an example of a software configuration of the host computer 202.

An application 402 and a transmission module 409 illustrated inside the host computer 202 in FIG. 4 are components realized by the CPU 302 executing the program stored in the ROM 304 or the external memory 312.

The application 402 is a program for realizing function units such as a creation method storage unit 403, a request information reception unit 404, a creation method determination unit 405, an imposition creation unit 406, a post-processing information attachment unit 407, and a print instruction unit 408 on the host computer 202.

The creation method storage unit 403 stores a creation method for the case binding (for example, FIGS. 7 and 8A, which will be described below). The creation method storage unit 403 stores information such as an orientation of a fold (for example, the top folding/the bottom folding), and folding imposition information and a position where post-processing information is supposed to be attached (for example, FIG. 14A, which will be described below) for each folding number (for example, 8/16/32), for each binding direction (for example, the right binding/the left binding) of the product. This information allows the creation method for the case binding to be acquired based on the binding direction and the folding number.

The request information reception unit 404 receives the request information transmitted from the order management server 101 in a format such as the comma separated value (CSV) format, and Job Definition Format (JDF) defined by the International Cooperation for the Integration of Processes in Prepress, Press, and Postpress Organization (CIP4), which is an international standardization organization. Further, the request information reception unit 404 may receive a print file, such as a Portable Document Format (PDF) file provided by Adobe Systems Incorporated, at the same time of receiving the request information. The print file may be prepared in some cases as an image or in a word processor format, such as the Word file format provided by Microsoft Corporation, or may be prepared in another format.

The creation method determination unit 405 determines the creation method including the orientation of the fold (for example, the top folding/the bottom folding), the position where the post-processing information is supposed to be attached (for example, positions where marks 1401 to 1405 are attached in FIG. 14A, which will be described below), and a print order (a normal order/a reverse order) based on the request information received by the request information reception unit 404. Processing for determining the creation method will be described below, and information indicating the determined creation method is provided to the imposition creation unit 406, the post-processing information attachment unit 407, and the print instruction unit 408, and is used in a prepress process and a press process.

The imposition creation unit 406 carries out the imposition of the submitted print file by using the orientation of the fold of the signature (the top folding/the bottom folding) that is determined by the creation method determination unit 405, the binding direction (the right binding/the left binding) acquired from the request information, and the number of times of the folding (for example, 8/16/32). The imposition creation unit 406 carries out the folding imposition while changing the imposition (for example, changing the imposition, like from FIG. 14A to FIG. 14B) if necessary.

The post-processing information attachment unit 407 attaches the post-processing information to the imposed print file by also using the orientation of the fold of the signature that is determined by the creation method determination unit 405, the binding direction acquired from the request information, and the number of times of the folding, and stores the file. The post-processing information attachment unit 407 attaches the post-processing information while recalculating the position where the post-processing information is supposed to be attached (for example, recalculating the position, like from FIG. 14A to FIG. 14B) if necessary.

The number of times of the folding is often determined depending on a size of paper prepared in the pressroom and a size of a portion to be printed in the print file, and is often not included in the request information. In this case, the number of times of the folding may be calculated by another method. A method for calculating an optimum number of times of the folding is a known technique, and therefore will not be described herein.

The print instruction unit 408 issues the print instruction while switching the printing from normal printing to reverse-order printing if necessary, according to the orientation of the fold of the signature that is determined by the creation method determination unit 405 and the binding direction acquired from the request information. The normal printing is print control that a front side is laid face down and a start page is output first on a paper discharge portion. On the other hand, the reverse-order printing is assumed to be print control that the front side is laid face down and the start page is output last on the paper discharge portion. However, in a case where the printer 203 is configured to carry out, as the normal printing, printing in which the front side is laid face up and the start page is output last on the paper discharge portion, the reverse-order printing may refer to a printing method in which the front side is laid face up and the start page is output first on the paper discharge portion. The application of the present exemplary embodiment is not limited for either case.

The transmission module 409 connects to the printer 203 and transmits the print data generated by the above-described method, and the transmission module 409 may be embedded in the application 402.

Next, the request information handled by the user or the application 402 in the present exemplary embodiment, and a user operation screen of the application 402 will be described.

FIG. 5 illustrates an example of the request information received by the request information reception unit 404.

In the example illustrated in FIG. 5, the request information is written in the CSV format, but the writing method and the file format may be any method and any format, respectively.

An order acceptance number (No.) 501 is a unique identification (ID) for identifying a content of the request. Information such as a request date and a delivery deadline, and the client is managed by the order management server 201 in association with this order acceptance No. 501.

A merchandise name 502 is a name indicating a form of the product. The merchandise name 502 is used for the application 402 to determine the manufacturing process and determine which printer and/or which post-processing apparatus the job should be transmitted to.

A binding direction 503 is information indicating the binding direction of the requested product. The binding direction 503 is used for the creation method determination unit 405 to determine the creation method.

It is desirable that the information indicating the binding direction 503 is input as the request information, but the printing system may be configured in such a manner that the information indicating the binding direction 503 is managed in another table in association with the order acceptance No. 501. The information indicating the binding direction 503 may be acquired by any method as long as the request information reception unit 404 of the application 402 can acquire it.

A product name 504 and a quantity 505 are a name and an order quantity of the product that are specified by the client, respectively, and are used for a display on a screen where the application 402 issues the manufacturing instruction.

Paper grammages 506, paper colors 507, and paper types 508 indicate specified types of paper to be used for the product, and grammages, colors, and types of respective pieces of paper for the body text and the front cover are specified therein. The paper grammage refers to a weight of the paper per unit area.

A page number 509 is the number of pages constituting the body text of the product, and is used as a parameter of a spine width when the application 402 issues the manufacturing instruction to the post-processing apparatus 205.

Pieces of data 510 are locations where pieces of print data to be used in respective printing processes of the body text and the front cover are placed in a file system, and are used when the application 402 issues the print instruction to the printer 203.

Figure 6:
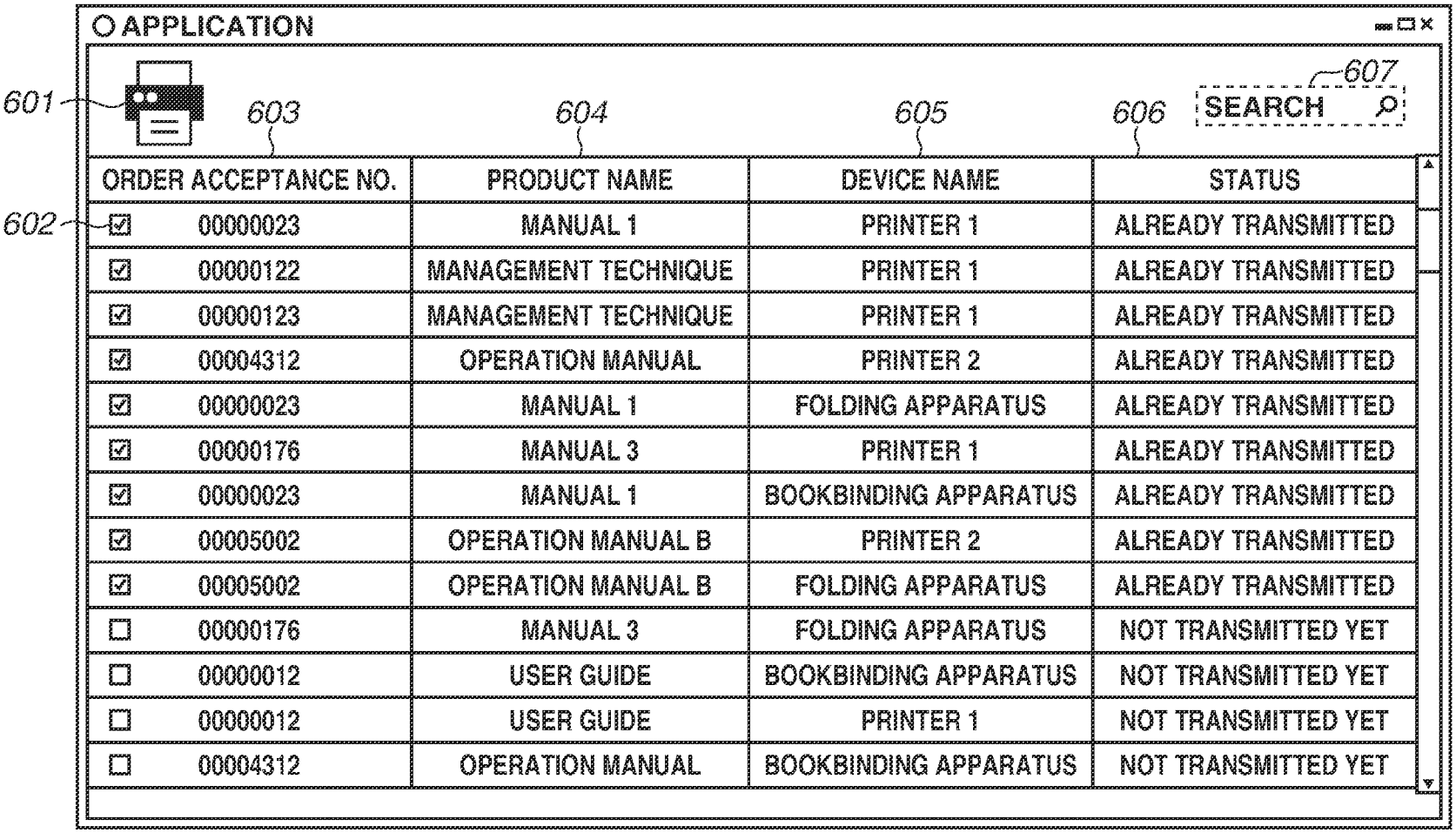
FIG. 6 illustrates an example of a user operation screen of an application.

FIG. 6 illustrates an example of the user operation screen of the application 402.

The application 402 causes the request information received from the request information reception unit 404 to be displayed in a list on the operation screen, as illustrated in FIG. 6.

Information about the instruction transmitted or to be transmitted to one apparatus (the printer 203 or the post-processing apparatus 204 or 205) is displayed in one line in the list. For example, if the printing system is requested to create a merchandise (suppose that this is a "manual 1" in the present example) that will be created through manufacturing processes of the printing at the printer 203, the folding at the folding apparatus 204, and the bookbinding at the bookbinding apparatus 205, this is displayed in three lines as a print job for the "manual 1", a folding job for the "manual 1", and a bookbinding job for the "manual 1" on the application 402, and the operation screen is structured so as to permit these jobs to be controlled individually.

A transmission button 601 is a button for transmitting the job displayed in a line selected on a check box 602 to the target printer 203/post-processing apparatus 204 or 205.

The check box 602 is used for control used to select the job to be transmitted.

An order acceptance No. 603 is the information written in the request information illustrated in FIG. 4, and one order acceptance No. 603 placed in a plurality of lines indicates different processes for the same product. For example, an order acceptance No. "00000023" has jobs transmitted to the printer 1, the folding apparatus 204, and the bookbinding apparatus 205 that are displayed in the three lines, and in this case, the order acceptance No. 603 indicates a product requiring the print job to the printer 1, the folding apparatus job including a setting of the folding to the folding apparatus 204, and the bookbinding job including a setting of the bookbinding to the bookbinding apparatus 205.

A product name 604 is a book name for uniquely identifying the product written in the request information.

A device name 605 indicates a destination to which the job has been or will be transmitted, and normally, the printer 203 and the post-processing apparatuses 204 and 205 connected to the host computer 202 via the network 206 are displayed in a list in a combo box format, so that the user can make a change as necessary.

A status 606 is a field that presents whether the job has been already transmitted to the corresponding device to the user, and the status displayed as having been already transmitted indicates that the setting of the job and the print file has reached the target apparatus.

A search window 607 is used to search a list of jobs assigned to the pressroom and narrow down the number of displayed jobs. For example, the search window 607 can be used to cause only jobs that have not been transmitted yet, to be displayed in the list, and press the transmission button 601 with all of the lines selected.

In the example of the list display illustrated in FIG. 6, the jobs for one product are displayed in the separated selection lines so as to allow each process for one product to be controlled separately, but may be displayed in one line so as to allow the jobs regarding one product to be controlled collectively. Further, the present exemplary embodiment relates to the method for manufacturing the product involving the folding and the bookbinding, but a product not involving the folding and the bookbinding may be included in the list. Presence of another post-processing apparatus between the folding apparatus 204 and the bookbinding apparatus 205 also does not bear any influence.

Next, how the method for creating the product is actually changed when the present exemplary embodiment is applied thereto will be described with reference to FIGS. 7, and 8A and 8B.

Figure 7:
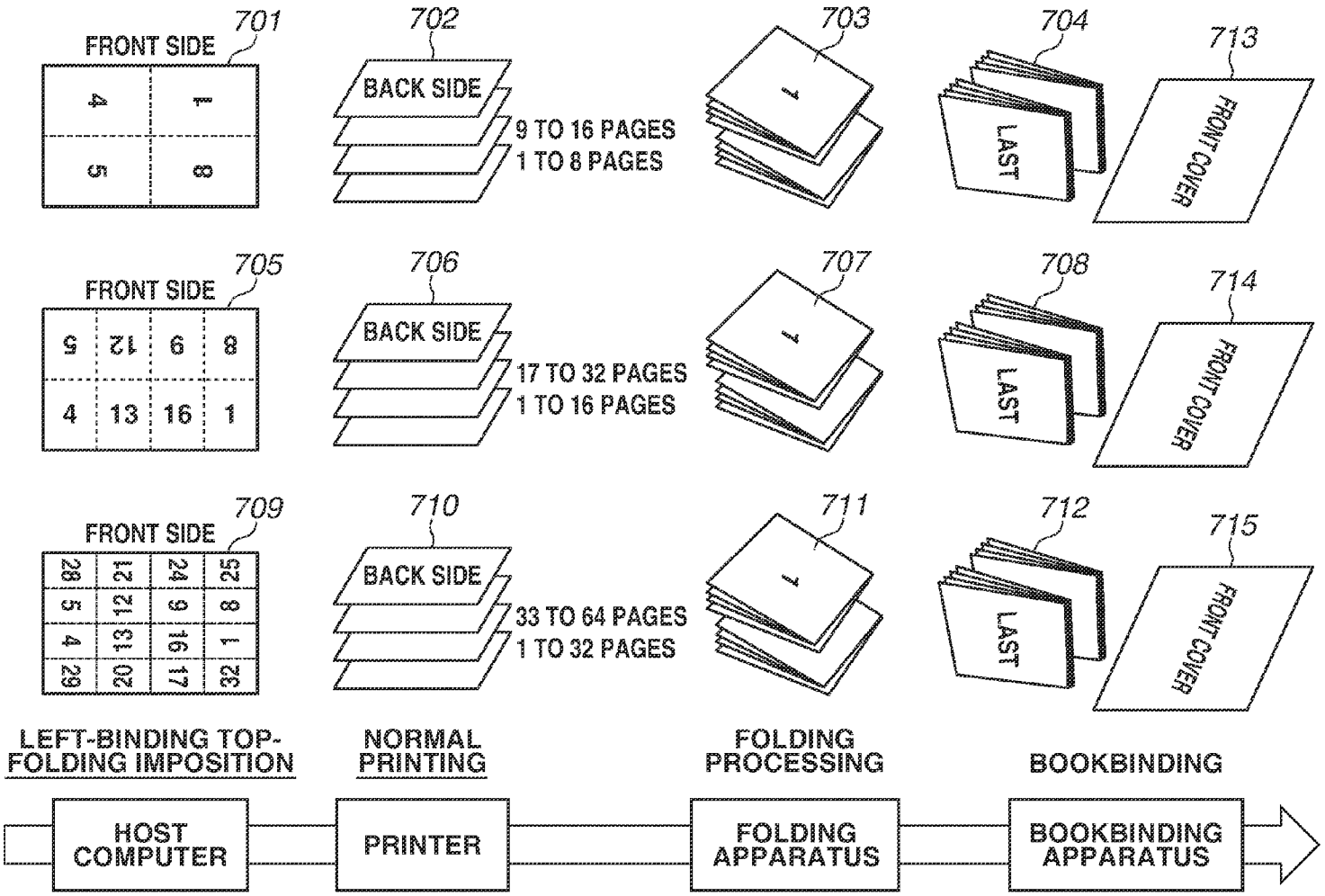
FIG. 7 illustrates an example of a method for creating a product of a binding direction serving as a reference.

FIG. 7 illustrates one example of the method for creating a product of a binding direction serving as a reference. In this example, FIG. 7 illustrates a method for creating the signature as the "left binding with the top folding".

Pieces of left-binding top-folding imposition print data 701, 705, and 709 are subjected to the imposition on the host computer 202, and are discharged on the printer 203 like printouts 702, 706, and 710, respectively. The folding imposition information and the like are determined in advance in correspondence with the binding direction and are stored in the creation method storage unit 403. Then, when an operator supplies the printouts 702, 706, and 710 placed on the paper discharge portion of the printer 203 into a paper feeding portion of the folding apparatus 204, signatures 703, 707, and 711 are created, respectively. FIG. 7 illustrates examples of the 8-page folding, the 16-page folding, and the 32-page folding in this order from a top row. Further, the operator supplies the signatures 703, 707, and 711 and printouts 713, 714, and 715 of front covers into the bookbinding apparatus 205, respectively, and performs processes 704, 708, and 712 of gluing the signatures 703, 707, and 711 and the front covers together, respectively, thereby creating bookbinding products.

Figure 8A:
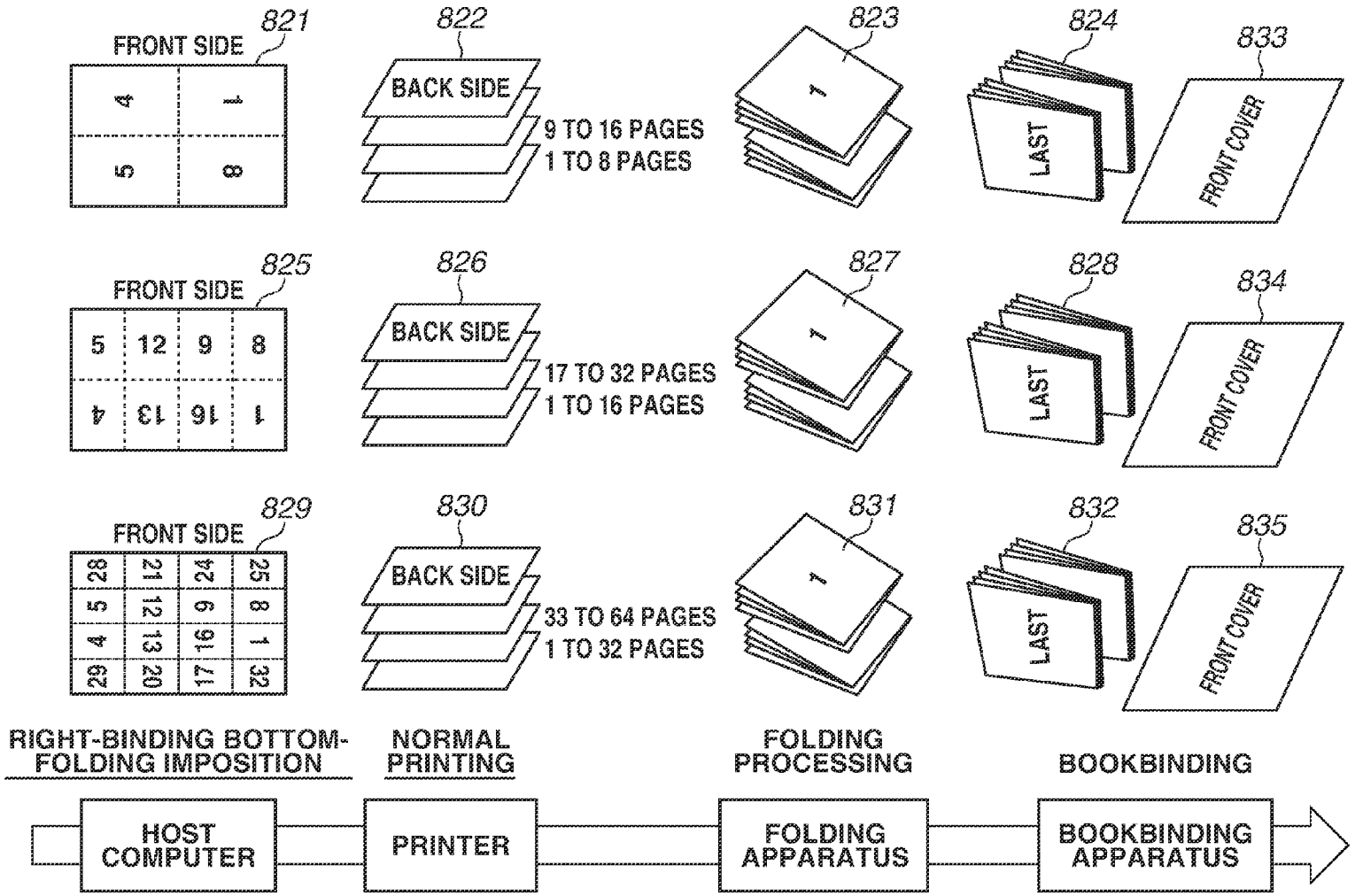
FIGS. 8A and 8B illustrate a change in a creation method in conformity with the creation method serving as the reference.
Figure 8B:
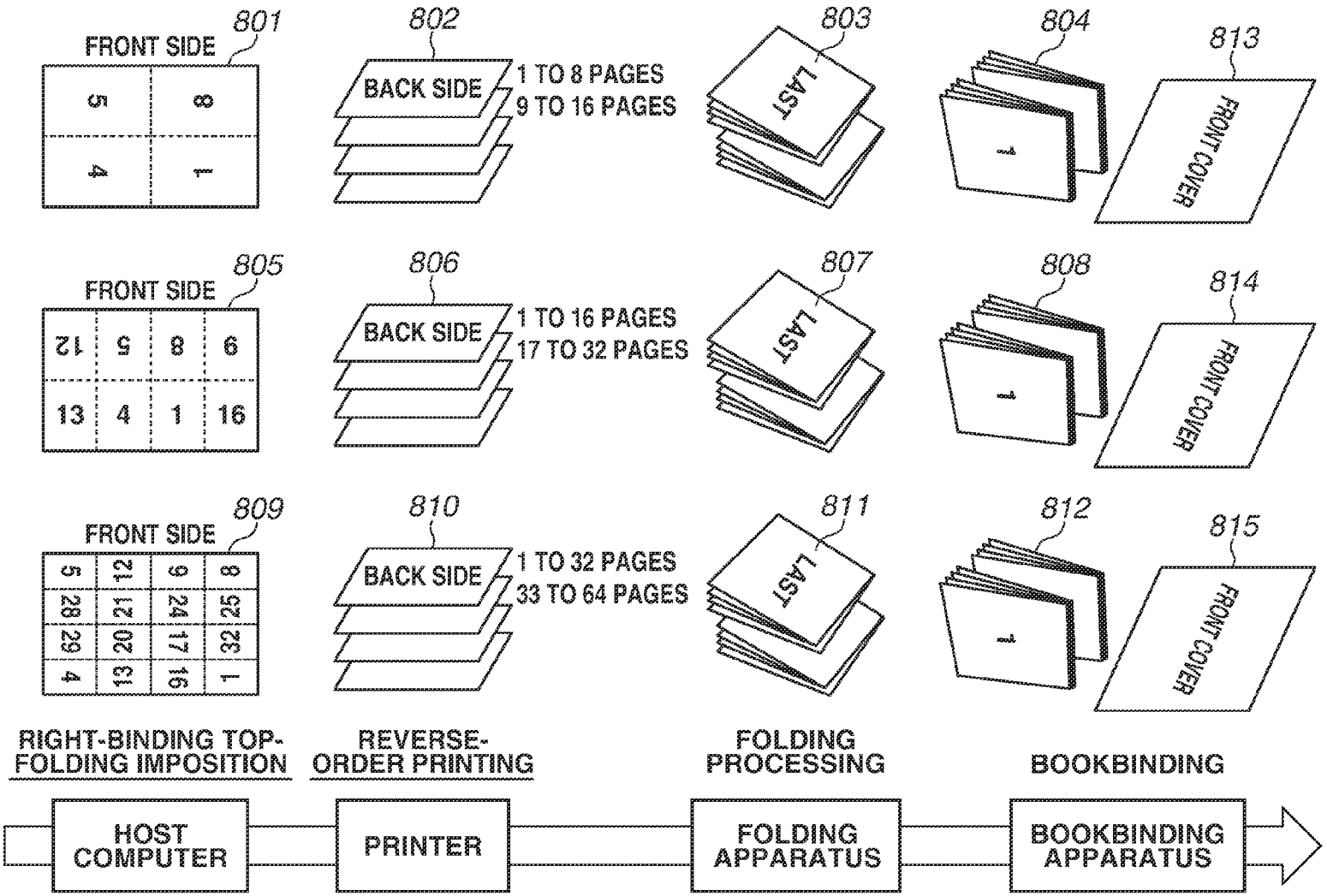

FIGS. 8A and 8B illustrate a change in the creation method in conformity with the creation method serving as the reference illustrated in FIG. 7 according to the present exemplary embodiment. In the present example, this change will be described referring to an example of creating a right-binding product in conformity with the method for creating the left-binding product illustrated in FIG. 7, which serves as the reference.

FIG. 8A illustrates an example of the method for creating a product of a different binding direction from the reference (a product of the right binding and bottom folding).

When the method for creating the product of the "right binding and bottom folding" is used without making the change according to the present exemplary embodiment, first, pieces of right-binding bottom-folding imposition print data 821, 825, and 829 are subjected to the imposition on the host computer 202, and are discharged on the printer 203 like printouts 822, 826, and 830, respectively. Then, when the operator supplies the printouts 822, 826, and 830 placed on the paper discharge portion of the printer 203 into the paper feeding portion of the folding apparatus 204, signatures 823, 827, and 831 are created, respectively. Further, the operator supplies the signatures 823, 827, and 831 and printouts 833, 834, and 835 of front covers into the bookbinding apparatus 205 in an illustrated direction, respectively, and performs processes 824, 828, and 832 of gluing the signatures 823, 827, and 831 and the front covers together, respectively, thereby creating bookbinding products.

When the product of the "right binding and bottom folding", which is different from the product of the "left binding and top folding" illustrated in FIG. 7, is created in the manner illustrated in FIG. 8A, the creation method at the folding apparatus 204 and after that is changed according to the binding direction, which complicates the method. This issue can be solved by changing the creation method in conformity with the creation method serving as the reference as illustrated in FIG. 8B, which will be described now.

FIG. 8B illustrates an example of the creation method changed in conformity with the creation method serving as the reference illustrated in FIG. 7.

When the creation method is changed in conformity with the creation method serving as the reference, first, the imposition print data to be created on the host computer 202 is created like pieces of print data 801, 805, and 809, which are the imposition of the same top folding, in conformity with the creation method serving as the reference (FIG. 7 in the present example). In other words, the print data for creating the signature as the "right binding with the top folding" is created. This created data is printed in the reverse order by the printer 203, and printouts 802, 806, and 810 discharged in the reverse order are acquired. Then, when the operator supplies the printouts 802, 806, and 810 placed on the paper discharge portion of the printer 203 into the paper feeding portion of the folding apparatus 204 and folds them with the same setting as FIG. 7, signatures 803, 807, and 811 illustrated in FIG. 8B are created, respectively. Further, the operator supplies the signatures 803, 807, and 811 and printouts 813, 814, and 815 of the front covers into the bookbinding apparatus 205 in a similar manner to FIG. 7, respectively, and performs processes 804, 808, and 812 of gluing the signatures 803, 807, and 811 and the front covers together, respectively, thereby creating the bookbinding products. This is a typical example of the method for creating the product when the present exemplary embodiment is applied thereto.

As illustrated in FIG. 8B, one characteristic when the present exemplary embodiment is applied is that, even at the time of the creation of the product of the "right binding" different from the "left binding" illustrated in FIG. 7, carrying out the imposition so as to achieve the same folding direction as the creation method illustrated in FIG. 7 and using the reverse-order printing as illustrated in FIG. 8B make the creation method at the folding apparatus 204 and after that consistent regardless of the binding direction.

The examples illustrated in FIGS. 7, and 8A and 8B are typical examples of the bookbinding using the signature, but the orientation of the fold, the number of imposed pages, and the number of times of the folding are not limited to these examples, and do not have to match those illustrated in FIGS. 7, and 8A and 8B. Especially, types of the number of times of the folding include the 8-page folding, the 16-page folding, the 32-page folding, and the like, but this number is unlimited as long as this is the signature. However, if the orientation of the fold, the number of imposed pages, and/or the number of times of the folding is/are different in the method for creating the product of the binding direction serving as the reference illustrated in FIG. 7, the method for creating the product illustrated in FIGS. 8A and 8B is also different according thereto.

FIGS. 15A to 15F and 16A to 16F each illustrate an example of a result of a change in the imposition method according to the change in the creation method illustrated in FIGS. 8A and 8B.

FIGS. 15A to 15F and 16A to 16F illustrate respective examples of the imposition for two sheets for the folding to create 4 pages on each side, the folding to create 8 pages on each side, and the folding to create 16 pages on each side in this order from the top. Respective rows labeled FIRST FOLDING and SECOND FOLDING on the left side indicate a first sheet and a second sheet. Left imposition 1501, 1503, 1505, 1507, 1509, 1511, 1601, 1603, 1605, 1607, 1609, or 1611 of each of the first sheet is a front side of the sheet, and right imposition 1502, 1504, 1506, 1508, 1510, 1512, 1602, 1604, 1606, 1608, 1610, or 1612 of each of the first sheet is a back side of the sheet. Arrows illustrated above the sheets indicate the orientation of the back side, and indicate that a position of the arrow illustrated above the front side and a position of the arrow illustrated above the back side are the same corner.

The examples illustrated in FIGS. 15A to 15F are each an example of a result of the imposition when the product of the right binding is adjusted in conformity with the method for creating the product of the left binding illustrated in FIG. 7, which serves as the reference, similarly to FIGS. 8A and 8B.

Generally, in the imposition of the signature, a sample indicating the imposition method that is called a folding sample is formulated by creating the completed signature 105, 111, or 117 and assigning the page numbers on this paper. FIGS. 15A, 15C, and 15E are developed views of folding samples of the "right binding" and bottom folding. On the other hand, FIGS. 15B, 15D, and 15F illustrate these samples with the imposition thereof changed in conformity with the creation method serving as the reference. To change the orientation of the fold, the print content of each page is printed upside down. At this time, laying out the pages in an inverse order sheet by sheet allows the product of the "right binding" to be created while the orientation of the fold is changed to the top folding. Inverting the page layout refers to calculating a sum of a smallest page number of the sheet and a largest page number of the sheet, subtracting an original page number from this sum, and then newly using the calculated page number.

The change in the imposition method will be described referring to the imposition 1501 and the imposition 1503 of the first folding by way of example. A first page 1513 of the imposition 1501 is imposition in which the page is printed in an orientation outward from the sheet. First, this printing orientation is changed to an orientation toward a center. Next, a new page number "8 (=9−1)" is acquired by subtracting a page number "1" of a target from a sum "9 (=1+8)" of a smallest page number of the sheet and a largest page number "8" of the sheet, and is disposed at the same position (1514). When the target is an upper right (1515) on the front side of the second folding, the printing orientation is vertically inverted, and then page 16, which is acquired by subtracting 9 from 25 (=9+16), is set as a new page number (1516). Performing a similar procedure on all pages on all sheets completes the new imposition 1503.

FIGS. 16A to 16F each illustrate a result of the imposition when the left-binding product is adjusted in conformity with the method for creating the right-binding product serving as the reference.

Figure 16A:
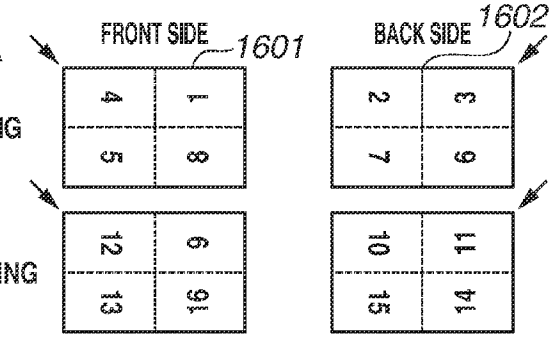
FIGS. 16A, 16B, 16C, 16D, 16E, and 16F illustrate a change in the imposition method in conformity with the left binding serving as the reference.
Figure 16C:
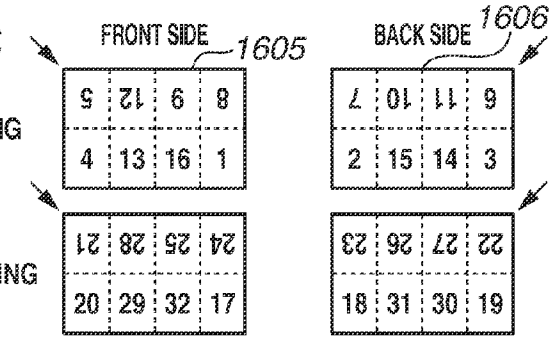
Figure 16E:
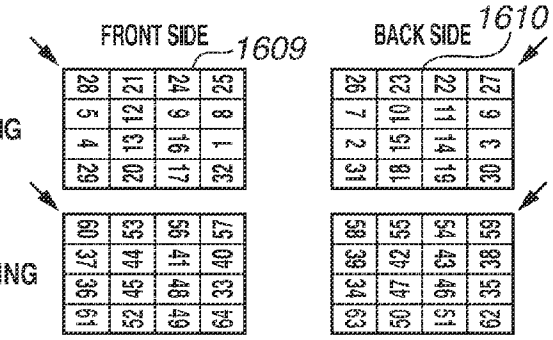
Figure 16B:
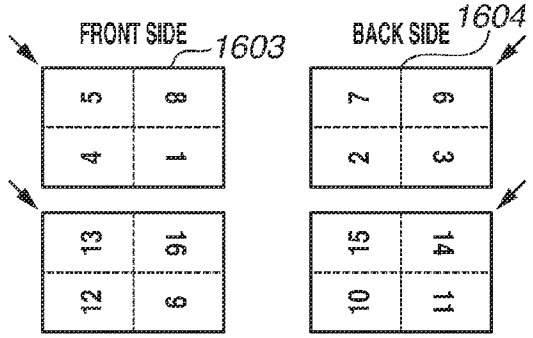
Figure 16D:
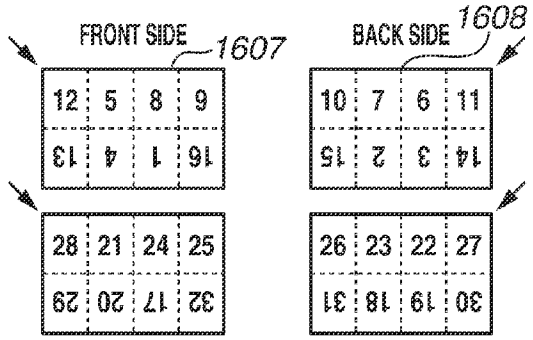
Figure 16F:
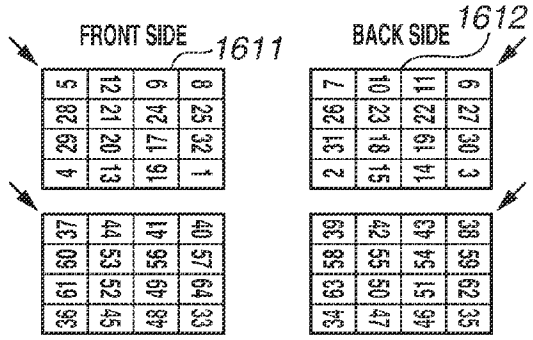

FIGS. 16A, 16C, and 16E are developed views of folding samples of the "left binding" and top folding. On the other hand, FIGS. 16B, 16D, and 16F illustrate these samples with the imposition thereof changed in conformity with the creation method serving as the reference.

The method for changing the imposition is a similar procedure to FIGS. 15A to 15F, in which the "right binding" and the bottom folding is changed to the "right binding" and the top folding. Vertically inverting the print content of each page first and laying out the pages in the inverse order sheet by sheet next allow the product of the "left binding" to be created while the orientation of the fold is changed to the bottom folding.

The method for changing the imposition described here is applicable regardless of whether the initial imposition before the change is the "left binding" and the bottom folding, the "right binding" and the top folding, "top binding", or "bottom binding", which are not included in the above-described examples. This method has such an advantage that, in such a case that the initial imposition before the change is carried out on another site, the imposition creation unit 406 of the application 402 does not have to hold an imposition template, which will be described below.

Further, another possible method for changing the imposition is to prepare templates corresponding to all types of signature imposition to be used by the imposition creation unit 406 of the application 402 in advance, and switch the imposition template to be used.

Figure 17:
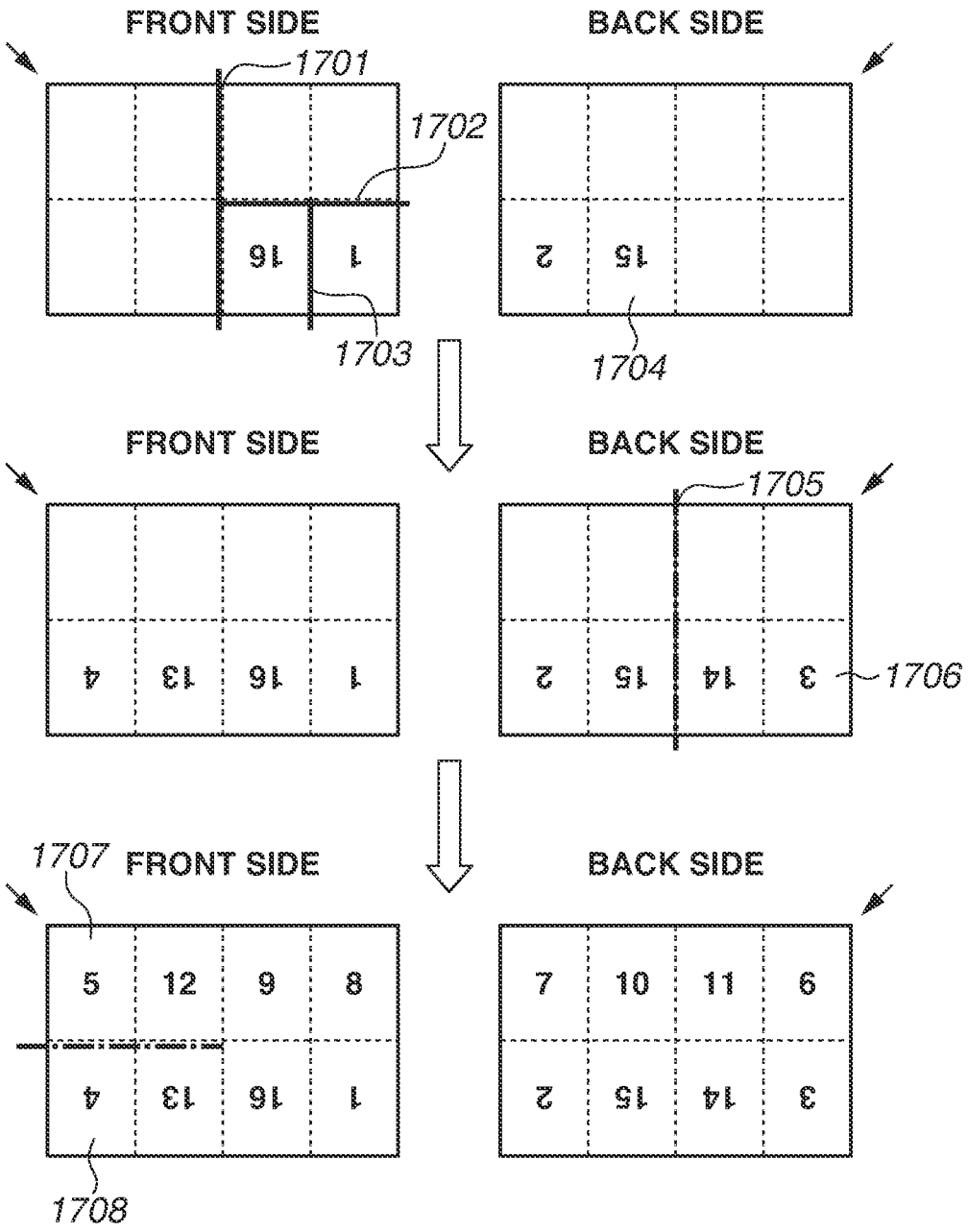
FIG. 17 illustrates the method for creating the signature imposition.

FIG. 17 illustrates an example of the method for creating the signature imposition before the change. A solid line and a chain line indicate a mountain fold and a valley fold, respectively.

The sheet is repeatedly folded to make mountain folds 1701 and 1702, and lastly a mountain fold 1703, and a first page and a last page in each sheet of the signature are disposed on positions that would be a right/left side and a left/right side of the mountain fold 1703. The first page and the last page are imposed on the eventual right side and left side of the mountain fold 1703, respectively, for the left binding, and are imposed on the eventual left side and right side of the mountain fold 1703, respectively, for the right binding. Regarding the page on the back side, a page number acquired by adding one page to the page on the front side is assigned if the page on the front side is an odd number, and a page number acquired by subtracting one page from the page number on the front side is assigned if the page on the front side is an even number. In the example illustrated in FIG. 17, numbers 1704 on the back side are set to "2" and "15" on the backs of "1" and "16", respectively. Next, regarding a page on a contact surface that would be brought into contact due to the valley fold, a page number acquired by subtracting one page from the other page is assigned if the other page is an odd number, and a page number acquired by adding one page to the other page is assigned if the other page is an even number. In the example illustrated in FIG. 17, pages 1706 on the contact surface that would be brought into contact due to a valley fold 1705 are set to "3" and "14" in eventual contact with "2" and "15", respectively. Further, pages 1707 that would be brought into contact due to a valley fold 1708 are set to "5" and "12" in eventual contact with "4" and "13", respectively.

In this manner, when the signature imposition is created, calculating the page number on the back side and the page number on the contact surface can derive the page number to be imposed regardless of which type of folding this signature is in terms of the type regarding the number of pages to be created therefrom.

Now, processing performed by the host computer 202 according to the present exemplary embodiment will be described with reference to the flowcharts.

Figure 9:
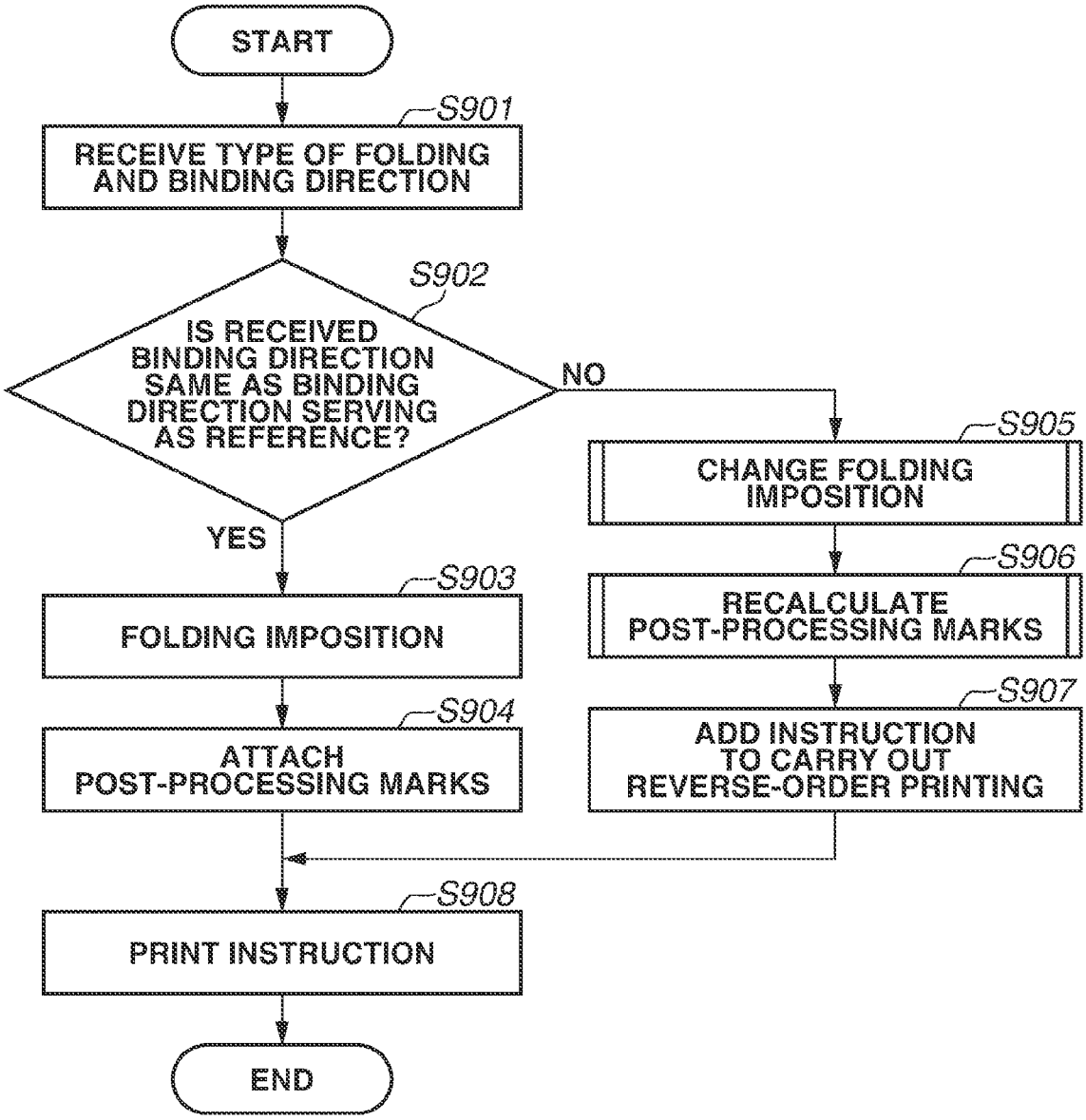
FIG. 9 is a flowchart illustrating an example of processing from reception of the request information to issue of a print instruction by the application.

FIG. 9 is a flowchart illustrating an example of processing performed by the application 402 from the reception of the request information to the issue of the print instruction. The CPU 302 of the host computer 202 reads out and executes the application program stored in the external memory 312, by which the processing of the flowcharts illustrated in FIG. 9, and FIGS. 10 and 12, which will be described below, is realized.

In step S901, the request information reception unit 404 receives the type of the folding and the binding direction. The type of the folding refers to the number indicating which type of signature should be created in terms of the type regarding the number of pages to be acquired therefrom (for example, 8/16/32), and is the type determined by the above-described method. Further, the binding direction is the binding direction 503 contained in the request information illustrated in FIG. 5.

Next, in step S902, the creation method determination unit 405 compares the binding direction serving as the reference and the binding direction received in the above-described step, step S901. Regarding the binding direction serving as the reference, the creation method determination unit 405 may use the "left binding" as an initial value, or the creation method storage unit 403 may hold the information as a configuration file of the application 402. The binding direction serving as the reference is assumed to be a direction with respect to which the setting is changeable by the user. After that, the reference binding direction used here will become the reference of the method for creating the signature and the orientation in which the paper is set at the time of the bookbinding, and the product will be created by performing the method for creating the signature and using the orientation in which the paper is set in a consistent manner regardless of which binding direction the product is bound at.

If the creation method determination unit 405 determines that the binding direction received in the above-described step, step S901 is the same as the binding direction serving as the reference in the above-described step, step S902 (YES in step S902), the processing proceeds to step S903.

In step S903, the creation method determination unit 405 issues an instruction to carry out the folding imposition of the binding direction serving as the reference stored in the creation method storage unit 403 that corresponds to the binding direction and the type of the folding received by the creation method determination unit 405 in the above described step, step S901, and the imposition creation unit 406 carries out this folding imposition. The folding imposition information used here is assumed to be, for example, information structured similarly to information illustrated in FIG. 11, which will be described below.

Next, in step S904, the creation method determination unit 405 issues an instruction to attach the post-processing information (the post-processing marks) onto the position where the post-processing information is supposed to be attached that corresponds to the binding direction and the type of the folding received by the creation method determination unit 405 in the above-described step, step S901, which is stored in the creation method storage unit 403, and the post-processing information attachment unit 407 carries out this attachment of the post-processing information.

Further, in step S908, the creation method determination unit 405 issues the print instruction, and the print instruction unit 408 issues the print instruction to the printer 203. In the present case, the printer 203 is instructed to carry out the normal printing (the printing in the normal order). The folding imposition, the attachment of the post-processing marks, and the print instruction are known methods, and therefore will not be described herein.

On the other hand, if the creation method determination unit 405 determines that the binding direction received in the above-described step, step S901 is different from the binding direction serving as the reference (NO in step S902), the processing proceeds to step S905.

In step S905, the creation method determination unit 405 issues an instruction to change the folding imposition, and the imposition creation unit 406 makes this change in the folding imposition. Processing for changing the folding imposition that is performed by the imposition creation unit 406 will be described in detail with reference to FIG. 10, which will be described below.

Next, in step S906, the creation method determination unit 405 issues an instruction to attach the post-processing information after recalculating the post-processing information (the post-processing marks), and the post-processing information attachment unit 407 attaches the post-processing information after recalculating this post-processing information. Processing for recalculating and attaching the post-processing marks that is performed by the post-processing information attachment unit 407 will be described in detail with reference to FIG. 12, which will be described below.

Further, in step S907, the creation method determination unit 405 issues an instruction to add an instruction to carry out the reverse-order printing, and the print instruction unit 408 adds the instruction to carry out the reverse-order printing.

Further, in step S908, the creation method determination unit 405 issues the print instruction, and the print instruction unit 408 issues the print instruction to the printer 203. This case leads to issue of the instruction to carry out the reverse-order printing to the printer 203.

A print command "PageDelivery" is used to add the instruction to carry out the reverse-order printing, which is issued by the print instruction unit 408, indicated in the above-described step, step S907, in a case where this print instruction is a print instruction using JDF.

PageDelivery can notify a printer or a printer controller capable of interpreting a JDF command of the instruction to change only the order of discharging the paper without changing the orientation of the discharged surface by adding a description specifying <DigitalPrintingParams PageDelivery="ReverseOrderFaceDown"/> in the JDF command. Processing performed by the printer 203 that has received the print instruction will be described with reference to FIG. 13. In a case where the use of the reverse-order printing is predetermined (the normal printing), the present exemplary embodiment can also be realized by employing a method that refrains from carrying out the reverse-order printing in step S907. Further, the present exemplary embodiment can also be applied even when a method other than a method using JDF is implemented to specify the order of discharging the paper.

In the above-described manner, if the binding direction received in the above-described step, step S901 is determined to be the binding direction serving as the reference (YES in step S902), in steps S903 and S904, the imposition processing and the attachment of the post-processing marks predetermined in correspondence with the above-described received binding direction are performed. Then, the instruction to carry out the printing is issued. On the other hand, if the above-described received binding direction is determined not to be the binding direction serving as the reference (NO in step S902), in steps S905 to S907, the imposition processing is changed from the imposition processing predetermined in correspondence with the above-described binding direction to the imposition processing that achieves the same folding direction as the above-described binding direction serving as the reference, and further, the above-described position where the information to be used in the post-processing is supposed to be attached is changed and the print instruction to reverse the order of discharging the paper is issued according to the above-described change in the imposition information.

Figure 10:
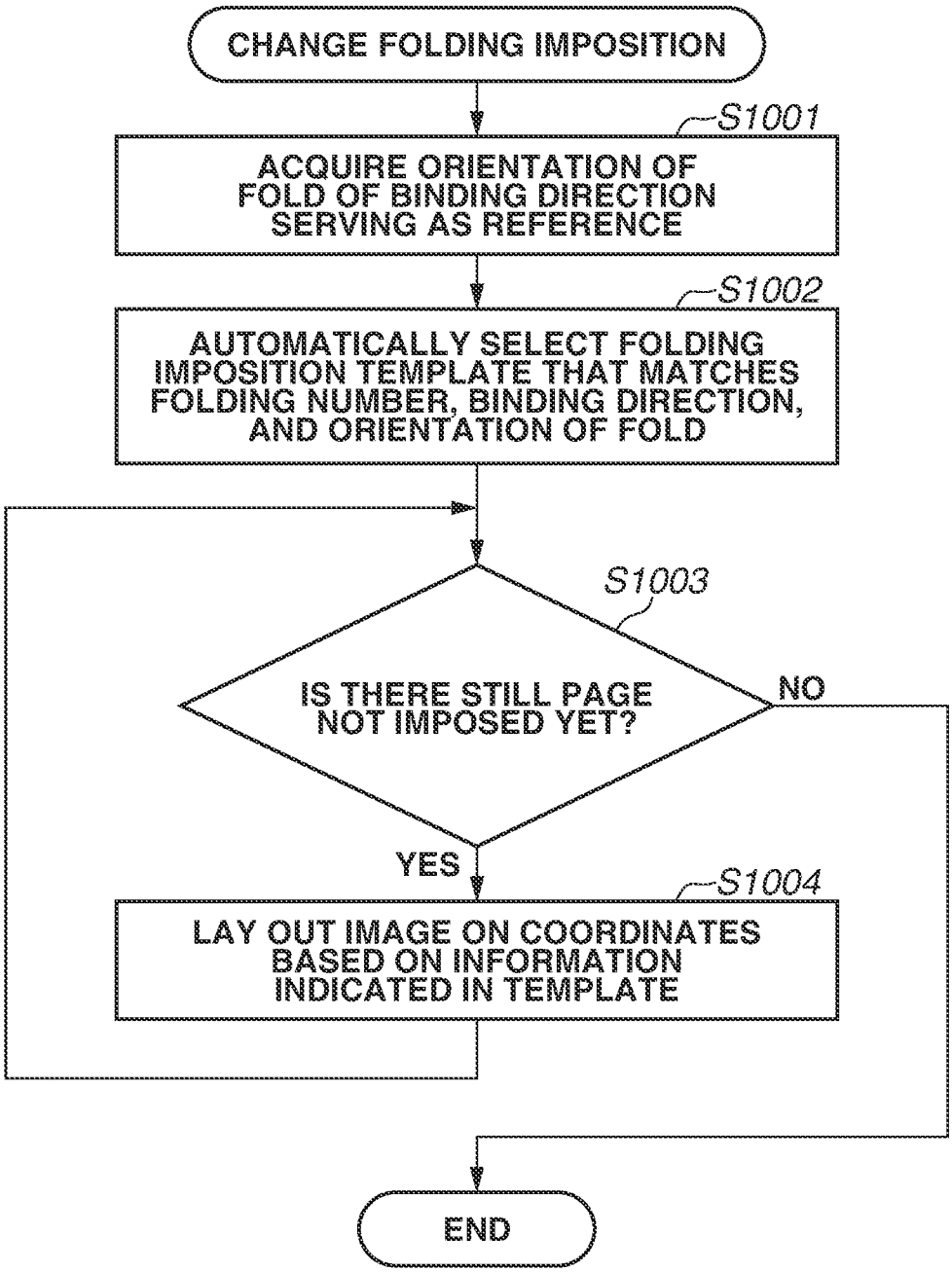
FIG. 10 is a flowchart illustrating an example of processing for changing folding imposition.

FIG. 10 is a flowchart illustrating an example of the processing for changing the folding imposition that is performed by the imposition creation unit 406 in step S905 illustrated in FIG. 9.

First, in step S1001, the imposition creation unit 406 acquires the orientation of the fold associated with the binding direction serving as the reference. For example, in the case where the "left binding" is acquired as the reference and the "left binding" is set so as to be created with the "top folding", even the product of the "right binding" is also created with the "top folding". This case leads to acquisition of information indicating the "top folding" in the present step.

Next, in step S1002, the imposition creation unit 406 uses the number of times of the folding (the type of the folding) and the binding direction acquired in step S901 illustrated in FIG. 9, and the orientation of the fold acquired in the above-described step, step S1001 to automatically select a folding imposition template that matches them. The folding imposition template is assumed to be, for example, something like information illustrated in FIG. 11, and stored in the external memory 312 of the host computer 202.

Next, in step S1003, the imposition creation unit 406 determines whether there is still a page that has not been imposed yet. Then, if the imposition creation unit 406 determines that there is still a page that has not been imposed yet (YES in step S1003), the imposition creation unit 406 sets one of the page(s) that has (have) not been imposed yet, as a current page, and the processing proceeds to step S1004.

In step S1004, the imposition creation unit 406 lays out a page image on coordinates of the current page based on information indicated in the template acquired in the above-described step, step S1002. Then, the processing proceeds to step S1003.

Then, if the imposition creation unit 406 determines that there is no longer a page not imposed yet (NO in step S1003), the imposition creation unit 406 ends the present processing for changing the folding imposition.

FIG. 11 illustrates an example of the imposition template written in the Extensible Markup Language (XML) format.

As illustrated in FIG. 11, the imposition template includes a catalog number 1101, the numbers of vertically and horizontally imposed pages 1102, a binding direction 1103, and a folding direction 1104 as attribute values.

The catalog number 1101 is a unique number defining the number of times of the folding and how to make the mountain fold and the valley fold. "F16" in the example illustrated in FIG. 11 indicates the 16-page folding.

The numbers of vertically and horizontally imposed pages 1102 indicate how many pages are laid out in a long-side direction and a short-side direction of the paper, and "4 2" in the example illustrated in FIG. 11 means that four pages and two pages are laid out in the long-side direction and the short-side direction, respectively.

The binding direction 1103 is set to "right", which means the "right binding". The binding direction 1103 set to "left" means the "left binding".

The folding direction 1104 is set to "head", which means the "top folding". The folding direction 1104 set to "foot" means the "bottom folding".

In other words, the imposition creation unit 406 can select the folding imposition template that matches the number of times of the folding (the type of the folding) and the binding direction acquired in step S901 illustrated in FIG. 9, and the orientation of the fold, with use of these pieces of information.

A page number 1105 indicates a page number in the submitted print data, and layout coordinates 1106 indicate which coordinates (a horizontal coordinate and a vertical coordinate from a lower left corner of the paper, and the front side (0) or the back side (1)) this page is laid out on.

In the example illustrated in FIG. 11, the layout coordinates 1106 indicate that a first page is imposed at a horizontally third and vertically first position from the lower left corner on the front side. The layout coordinates 1106 indicate that a second page is imposed at a horizontally second and vertically first position from the lower left corner on the back side. The layout coordinates 1106 indicate that a third page is imposed at a horizontally third and vertically first position from the lower left corner on the back side. The layout coordinates 1106 indicate that a sixteenth page is imposed at a horizontally fourth and vertically first position from the lower left corner on the front side.

The imposition creation unit 406 carries out the imposition based on the information indicating the layout coordinates in the selected template, like the above-described template.

In the example illustrated in FIG. 11, the imposition template has been described referring to the example of the imposition template written in the XML format, but the format of writing the template does not have to be XML. Further, the imposition method employed here may be an imposition method that carries out the imposition by individually calculating the coordinates without use of the template.

Figure 12:
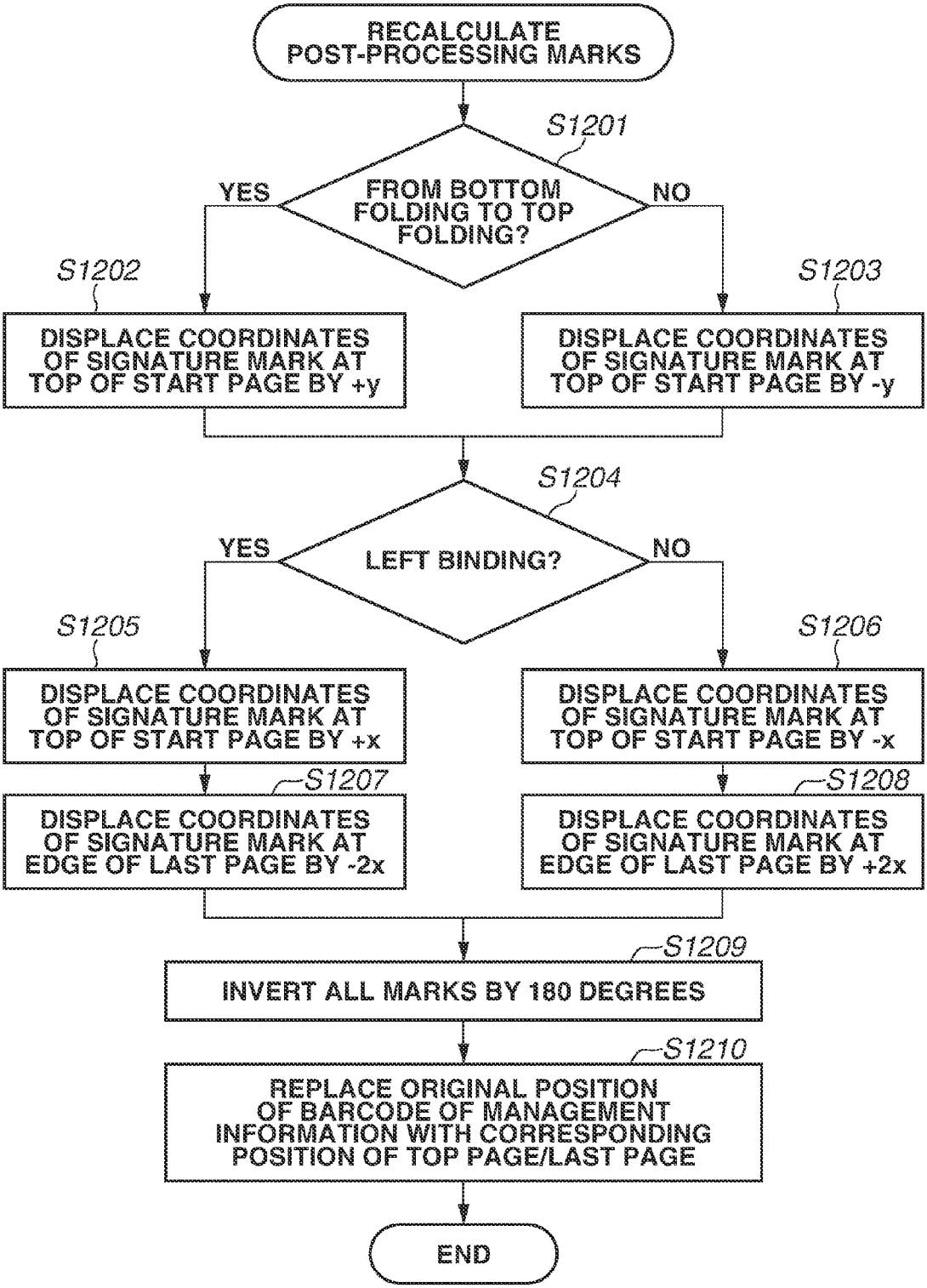
FIG. 12 is a flowchart illustrating an example of processing for recalculating post-processing marks.

FIG. 12 is a flowchart illustrating an example of the processing for recalculating and attaching the post-processing mark that is performed by the post-processing information attachment unit 407 in step S906 illustrated in FIG. 9.

First, in step S1201, the post-processing information attachment unit 407 determines whether, when the imposition has been changed in conformity with the reference binding direction in step S905 (FIG. 10) illustrated in FIG. 9, this change has been the change from the "bottom folding" to the "top folding". As described above, the "orientation of the fold" is stored in the creation method storage unit 403 in association with the "binding direction". For example, in the case where the "top folding" and the "bottom folding" are associated with the "left binding" and the "right binding", respectively, the post-processing information attachment unit 407 determines that the "orientation of the fold" has been changed from the "bottom folding" to the "top folding" in this step if the binding direction received in the above-described step, step S901 has been the "right binding".

If the post-processing information attachment unit 407 determines that the change has been the change from the "bottom folding" to the "top folding" in the above-described step, step S1201 (YES in step S1201), the processing proceeds to step S1202.

Figure 14A:
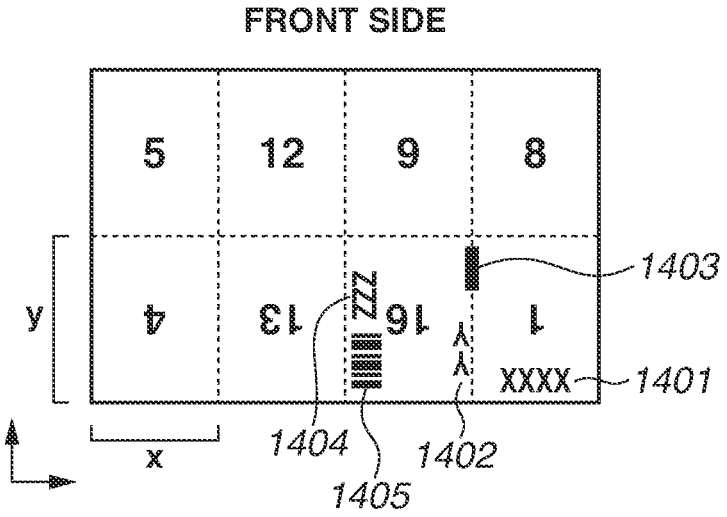
FIGS. 14A and 14B each illustrate a relationship between a paper surface processed by the folding imposition and a layout of the post-processing marks.
Figure 14B:
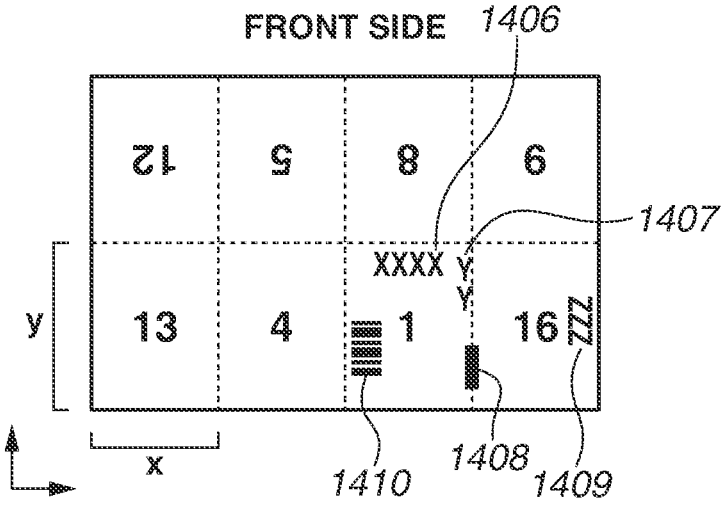

In step S1202, the post-processing information attachment unit 407 displaces coordinates of a signature mark on a top edge in a positive direction of the long-side direction of the page by one page ("+y") (refer to the marks 1401 and 1406 illustrated in FIGS. 14A and 14B).

Now, assume that an origin is set at the lower left corner of the paper surface where the first page is disposed, and a rightward direction is set as a positive direction of the left-right direction and an upward direction is set as a positive direction of the vertical direction. Further, the short side and the long side of one page are expressed as x and y, respectively.

On the other hand, if the post-processing information attachment unit 407 determines that the change has been the change from the "top folding" to the "bottom folding" in the above-described step, step S1201 (NO in step S1201), the processing proceeds to step S1203.

In step S1203, the post-processing information attachment unit 407 displaces the coordinates of the signature mark on the top edge in a negative direction of the long-side direction of the page by one page ("−y").

After the processing in the above-described step, step S1202 or S1203, in step S1204, the post-processing information attachment unit 407 determines whether the binding direction of the product received in step S901 illustrated in FIG. 9 has been the "left binding". Then, if the post-processing information attachment unit 407 determines that this binding direction has been the "left binding" (YES in step S1204), the processing proceeds to steps S1205 and S1207.

In step S1205, the post-processing information attachment unit 407 displaces the coordinates of the signature mark on the top edge in a positive direction of the short-side direction by one page (+x).

Further, in step S1207, the post-processing information attachment unit 407 displaces coordinates of a signature mark on a fore edge in a negative direction of the short-side direction by two pages (−2x).

On the other hand, if the post-processing information attachment unit 407 determines that the binding direction has been the "right binding" (NO in step S1204), the processing proceeds to steps S1206 and S1208.

In step S1206, the post-processing information attachment unit 407 displaces the coordinates of the signature mark on the top edge in the negative direction of the short-side direction by one page ("−x") (refer to the marks 1401 and 1406 illustrated in FIGS. 14A and 14B).

Further, in step S1208, the post-processing information attachment unit 407 displaces the coordinates of the signature mark on the fore edge in the positive direction of the short-side direction by two pages ("+2x") (refer to the marks 1404 and 1409 illustrated in FIGS. 14A and 14B).

After the processing in the above-described step, step S1207 or S1208, in step S1209, the post-processing information attachment unit 407 inverts, by 180 degrees, all of the post-processing marks, such as the signature mark on the top edge (for example, the mark 1406 illustrated in FIG. 14B), the signature mark on the fore edge (for example, the mark 1409 illustrated in FIG. 14B), a signature mark on the spine edge (for example, a mark 1407 illustrated in FIG. 14B), a collating mark (for example, a mark 1408 illustrated in FIG. 14B), and management information such as a barcode (for example, a barcode 1410 illustrated in FIG. 14B) to be used by the post-processing apparatus(es) 204 and/or 205. This inversion allows the post-processing marks to be disposed at positions that would also be physically visible after the signatures are collated, even if being subjected to the change in the imposition of the signature illustrated in FIG. 10.

Further, in step S1210, the post-processing information attachment unit 407 changes the position of the management information such as the barcode to be used by the post-processing apparatus(es) 204 and/or 205 by replacing the original position thereof with the corresponding position of the first page on the first sheet (the top page) or the last page (refer to the barcodes 1405 and 1410 illustrated in FIGS. 14A and 14B). For example, in a case where the position of the management information such as the barcode to be used by the post-processing apparatus(es) 204 and/or 205 is located on the first page on the first sheet, this position is replaced with the corresponding position of the last page on the last sheet. Conversely, in a case where the position of the management information to be used by the post-processing apparatus(es) 204 and/or 205 is located on the last page on the last sheet, this position is replaced with the position on the first page on the first sheet (refer to the barcodes 1405 and 1410 illustrated in FIGS. 14A and 14B). This replacement can solve the issue of losing the visibility of the printed mark of the management information or making impossible for the sensor to read out the printed mark when a bundle of signatures is set on the bookbinding apparatus 205, which otherwise might be caused by the change in the imposition of the signature. In a case where the imposition creation unit 406 is in charge of attaching the signature mark on the top edge, the signature mark on the fore edge, the signature mark on the spine edge, the collating mark, and the like, the recalculation of the coordinates may be carried out at the same time as the instruction to change the folding imposition that is illustrated in FIG. 10.

After the processing in the above-described step, step S1210, the post-processing information attachment unit 407 ends the present processing for recalculating the post-processing marks.

Figure 13:
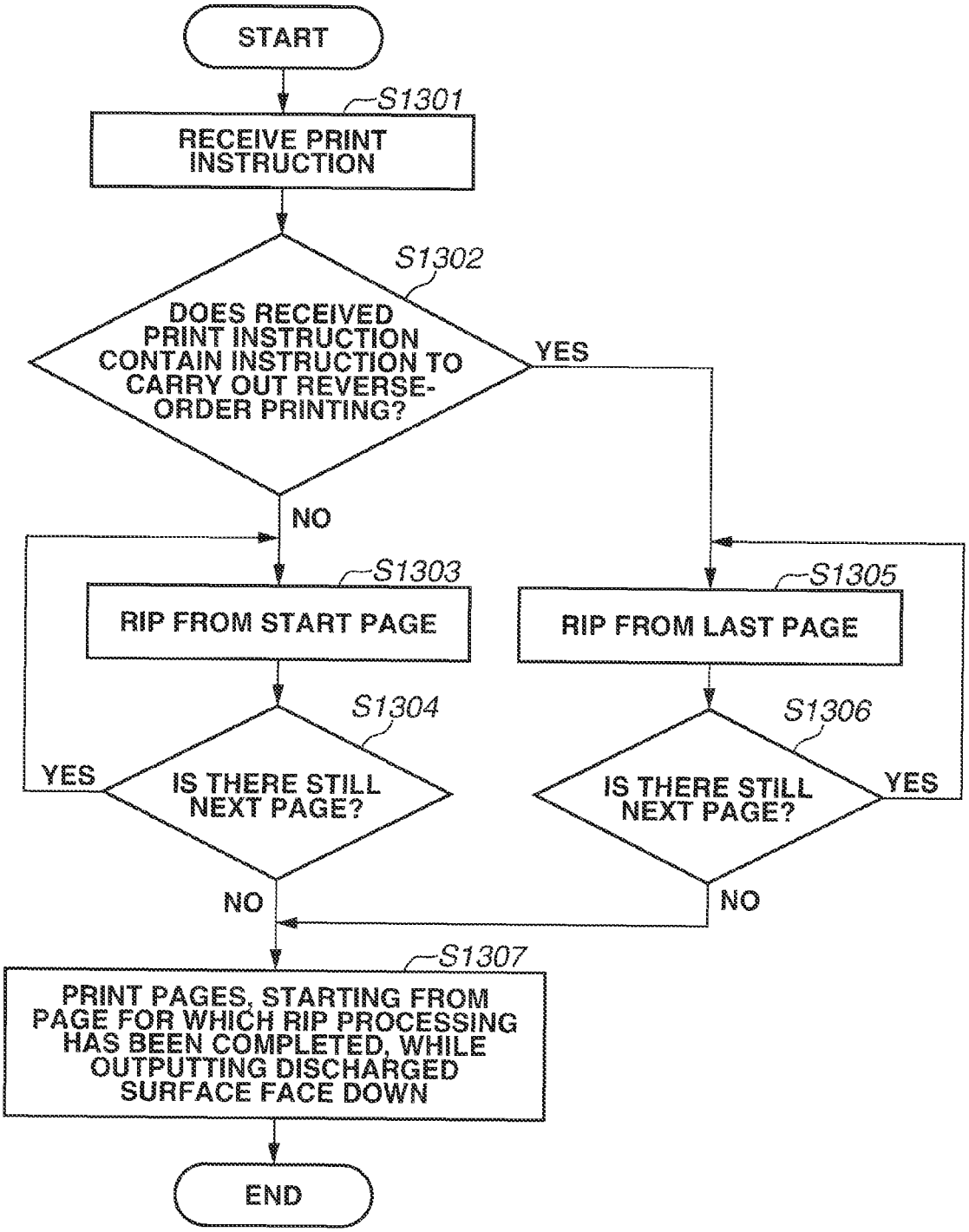
FIG. 13 is a flowchart illustrating an example of processing for switching normal printing and reverse-order printing.

FIG. 13 is a flowchart illustrating an example of the processing from the reception of the print instruction to the determination about whether to carry out the reverse-order printing and the execution of the printing by the printer 203. The CPU 314 of the printer 203 reads out and executes the program stored in the ROM 316, by which the processing of the flowchart illustrated in FIG. 13 is realized.

First, in step S1301, the CPU 314 of the printer 203 receives the print instruction created by the application 402 of the host computer 202.

Next, in step S1302, the CPU 314 determines whether the print instruction received in the above-described step, step S1201 contains the instruction to carry out the reverse-order printing similar to the above-described JDF command. Then, if the CPU 314 determines that the print instruction does not contain the instruction to carry out the reverse-order printing (NO in step S1302), in steps S1303 and S1304, the CPU 314 performs raster image processor (RIP) processing on the pages from the start page to the last page in order. Then, the processing proceeds to step S1307.

On the other hand, if the CPU 314 determines that the print instruction contains the instruction to carry out the reverse-order printing (YES in step S1302), in steps S1305 and S1306, the CPU 314 performs the RIP processing on the pages from the last page to the start page in order. Then, the processing proceeds to step S1307.

In step S1307, the CPU 314 carries out the printing, starting from the page on which the RIP processing has been completed while discharging the paper with the discharged surface thereof output face down, thereby switching the normal printing and the reverse-order printing.

The present flowchart has been described referring to the method that carries out the printing with the RIP processing branching between the normal printing and the reverse-order printing. However, the RIP processing may be performed similarly between the normal processing and the reverse-order processing as long as the order of discharging the paper can be controlled.

Now, a relationship between the paper surface processed by the imposition and the layout of the post-processing marks will be described.

FIGS. 14A and 14B each illustrate a relationship between the paper surface processed by the imposition for the 16-page folding and the layout of the post-processing marks.

FIG. 14A illustrates a relationship between the paper surface processed by the "right-binding bottom-folding imposition" for the 16-page folding, and the layout of the post-processing marks.

The signature mark 1401 on the top edge, the signature mark 1402 on the spine edge, the collating mark 1403, the signature mark 1404 on the fore edge, and the management information 1405 such as the barcode to be used by the post-processing apparatus(es) 204 and/or 205 are disposed at the illustrated positions on the first page or the sixteenth page so as to be located at the respective visible positions on the outer side of the signature. The management information is assumed to be disposed at the illustrated position on the last sheet.

On the other hand, FIG. 14B illustrates a relationship between the paper surface when the paper surface processed by the "right-binding bottom-folding imposition" for the 16-page folding illustrated in FIG. 14A is changed to the paper surface of the "right-binding top-folding imposition", and the layout of the post-processing marks.

This relationship is characterized in that, while the signature mark 1406 on the top edge, the signature mark 1407 on the spine edge, the collating mark 1408, and the signature mark 1409 on the fore edge are positionally readjusted according to the change in the imposition, the management information 1410 such as the barcode to be used by the post-processing apparatus(es) 204 and/or 205 is disposed at the same position as the management information 1405 illustrated in FIG. 14A on the first sheet.

The examples illustrated in FIGS. 14A and 14B are one example of a result of applying the processing for recalculating and attaching the post-processing marks illustrated in FIG. 12, and the processing for recalculating and attaching the post-processing marks illustrated in FIG. 12 is also applicable even when the folding number, the binding direction, and/or the folding direction is/are different from this example.

In the above-described manner, according to the present exemplary embodiment, the operator no longer has to switch the orientations of the signature and the front cover according to the binding direction and therefore can perform the manufacturing method for the case binding in a consistent manner regardless of the binding direction, during the case binding of the signature. Therefore, the operator no longer has to engage in the task of determining the binding direction and switching the orientation of the front cover with respect to the front cover placed on the paper discharge portion of the printer 203 based on the picture thereon and/or the management information indicating the orientation regarding the binding direction, which can reduce the work load on the operator, thereby improving the work efficiency of the operator and reducing the factor to cause a mistake.

In other words, the present exemplary embodiment can realize the print control capable of reducing the load on the operator at the time of the case binding of the signature, thereby improving the work efficiency and preventing or reducing the occurrence of a mistake.

In the above description, the POD printing system, which receives the request for the print product from outside the pressroom and manufactures the book based on this information, is merely one example of an embodiment of the present invention, and the system to which the present invention is applied does not have to be especially the POD printing system involving the request from outside as long as this system is the printing system that carries out the bookbinding using the signature. Further, in the above-described examples, the "left binding" and the "right binding" have been described, but the present invention is also effective even for a product configured to be bound at either side in the vertical direction with respect to the printed content.

The structures of the above-described various kinds of data and contents thereof are not limited thereto, and these pieces of data may be structured in various manners and/or have various contents according to an intended use and purpose.

Although one exemplary embodiment has been described, the present invention can also be embodied as, for example, a system, an apparatus, a method, a program, and a storage medium. More specifically, the present invention may be applied to a system including a plurality of devices, and may also be applied to an apparatus including only a single device.

Further, all of configurations in which the above-described individual exemplary embodiments are combined with each other are also included in the present invention.

According to the above-described exemplary embodiment, it is possible to realize the print control capable of reducing the load on the operator at the time of the case binding of the signature, thereby improving the work efficiency and preventing or reducing the occurrence of a mistake.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-155654, filed Aug. 6, 2015, and No. 2016-106210, filed May 27, 2016, which are hereby incorporated by reference herein in their entirety.

What is claimed is:

1. A print control apparatus comprising:

a reception unit configured to receive a request for printing that contains a binding direction at the time of case binding using a signature;

a determination unit configured to determine whether the binding direction contained in the request received by the reception unit is a predetermined binding direction; and a control unit configured to perform imposition processing so as to achieve a predetermined folding direction of the signature and issue an instruction to carry out the printing if the received binding direction is determined to be the predetermined binding direction, and perform the imposition processing in such a manner that a folding direction of the signature matches the predetermined folding direction of the signature and also issue an instruction to carry out the printing so as to reverse an order of a discharging paper if the received binding direction is determined not to be the predetermined binding direction.

2. The print control apparatus according to claim 1, wherein the predetermined binding direction is left binding, and wherein the control unit carries out imposition so as to achieve the left binding and top folding and issues the instruction to carry out the printing if the received binding direction is the left binding, and carries out the imposition so as to achieve right binding and the top folding and also issues the instruction to carry out the printing so as to reverse the order of the discharging paper if the received binding direction is determined to be the right binding.

3. The print control apparatus according to claim 1, wherein the predetermined binding direction is right binding, and wherein the control unit carries out imposition so as to achieve the right binding and bottom folding and issues the instruction to carry out the printing if the received binding direction is the right binding, and carries out the imposition so as to achieve left binding and the bottom folding and also issues the instruction to carry out the printing so as to reverse the order of the discharging paper if the received binding direction is determined to be the left binding.

4. The print control apparatus according to claim 1, further comprising a storage unit configured to store imposition information for each combination of the binding direction and the folding direction, wherein the control unit changes the imposition processing by acquiring, from the storage unit, the imposition information corresponding to the combination of the received binding direction and the folding direction of the imposition processing predetermined in correspondence with the predetermined binding direction.

5. The print control apparatus according to claim 4, wherein the control unit attaches information to be used in post-processing at a position predetermined in correspondence with the received binding direction if the received binding direction is determined to be the predetermined binding direction, and changes the position where the information to be used in the post-processing is supposed to be attached according to the change in the imposition information if the received binding direction is determined not to be the predetermined binding direction.

6. The print control apparatus according to claim 5, wherein the information to be used in the post-processing includes at least one of a signature mark on a top edge, a signature mark on a spine edge, a collating mark, a signature mark on a fore edge, and a barcode.

7. The print control apparatus according to claim 1, further comprising a setting unit configured to set the predetermined binding direction.

8. A method for controlling a print control apparatus, the method comprising:

receiving a request for printing that contains a binding direction at the time of case binding using a signature;

determining whether the binding direction contained in the request received by the receiving is a predetermined binding direction; and performing control of performing imposition processing so as to achieve a predetermined folding direction of the signature and issuing an instruction to carry out the printing if the received binding direction is determined to be the predetermined binding direction, and performing the imposition processing in such a manner that a folding direction of the signature matches the predetermined folding direction of the signature and also issuing an instruction to carry out the printing so as to reverse an order of a discharging paper if the received binding direction is determined not to be the predetermined binding direction.

9. The method for controlling the print control apparatus according to claim 8, wherein the predetermined binding direction is left binding, and wherein the control includes carrying out imposition so as to achieve the left binding and top folding and issuing the instruction to carry out the printing if the received binding direction is the left binding, and carrying out the imposition so as to achieve right binding and the top folding and also issuing the instruction to carry out the printing so as to reverse the order of the discharging paper if the received binding direction is determined to be the right binding.

10. The method for controlling the print control apparatus according to claim 8, wherein the predetermined binding direction is right binding, and wherein the control includes carrying out imposition so as to achieve the right binding and bottom folding and issuing the instruction to carry out the printing if the received binding direction is the right binding, and carrying out the imposition so as to achieve left binding and the bottom folding and also issuing the instruction to carry out the printing so as to reverse the order of the discharging paper if the received binding direction is determined to be the left binding.

11. A non-transitory computer-readable storage medium storing a program for causing a computer to function as:

a reception unit configured to receive a request for printing that contains a binding direction at the time of case binding using a signature;

a determination unit configured to determine whether the binding direction contained in the request received by the reception unit is a predetermined binding direction; and a control unit configured to perform imposition processing so as to achieve a predetermined folding direction of the signature and issue an instruction to carry out the printing if the received binding direction is determined to be the predetermined binding direction, and perform the imposition processing in such a manner that a folding direction of the signature matches the predetermined folding direction of the signature and also issue an instruction to carry out the printing so as to reverse an order of a discharging paper if the received binding direction is determined not to be the predetermined binding direction.

* * * * *